US007427973B2

(12) United States Patent
Itakura et al.

(10) Patent No.: US 7,427,973 B2
(45) Date of Patent: Sep. 23, 2008

(54) DISPLAY DEVICE AND METHOD OF DRIVING SAME

(75) Inventors: Naoyuki Itakura, Kanagawa (JP); Hiroaki Ichikawa, Kanagawa (JP)

(73) Assignee: Sony Corporation (JP)

( * ) Notice: Subject to any disclaimer, the term of this patent is extended or adjusted under 35 U.S.C. 154(b) by 622 days.

(21) Appl. No.: 10/774,568

(22) Filed: Feb. 10, 2004

(65) Prior Publication Data

US 2004/0189681 A1 Sep. 30, 2004

(30) Foreign Application Priority Data

Feb. 19, 2003 (JP) ..... P2003-041642

(51) Int. Cl.
*G09G 3/36* (2006.01)

(52) U.S. Cl. ..... 345/89; 345/98; 345/100; 345/103

(58) Field of Classification Search ..... 345/89, 345/98, 100, 103
See application file for complete search history.

(56) References Cited

U.S. PATENT DOCUMENTS 5,883,609 A * 3/1999 Asada et al. ..... 345/100
5,949,391 A * 9/1999 Saishu et al. ..... 345/50

* cited by examiner

*Primary Examiner*—Richard Hjerpe
*Assistant Examiner*—Leonid Shapiro
(74) *Attorney, Agent, or Firm*—Rader Fishman & Grauer PLLC; Ronald P. Kananen

(57) ABSTRACT

A display device able to select a driving capability corresponding to a plurality of resolutions, able to be driven in accordance with the purpose, and able to realize a lower power consumption, and a method of driving the same, providing a vertical drive circuit for processing for successively scanning scan lines in a row direction by scan pulses and successively selecting pixel circuits connected to the scan lines in units of rows in a VGA mode and for processing for successively scanning the scan lines for every adjacent plurality of scan lines in the row direction and successively selecting pixel circuits connected to the plurality of scan lines in units of the plurality of rows in a QVGA mode.

15 Claims, 20 Drawing Sheets

FIG. 8A
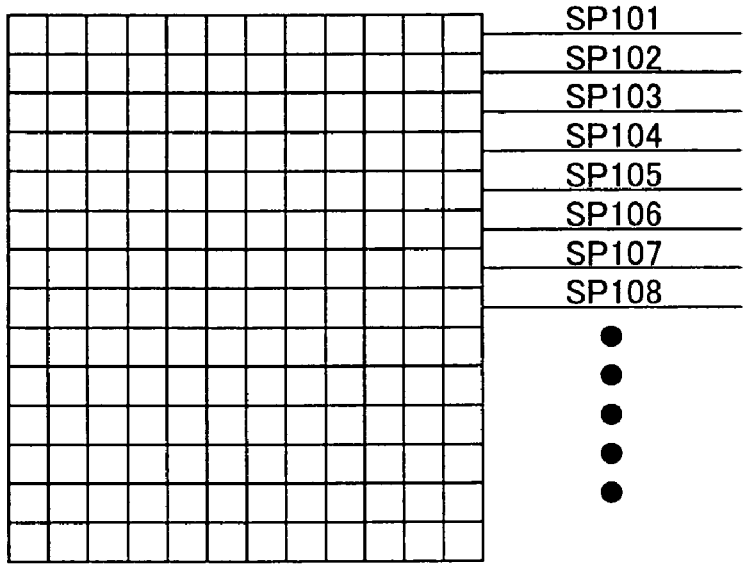
FIG. 8B
FIG. 8C
FIG. 8D
FIG. 8E
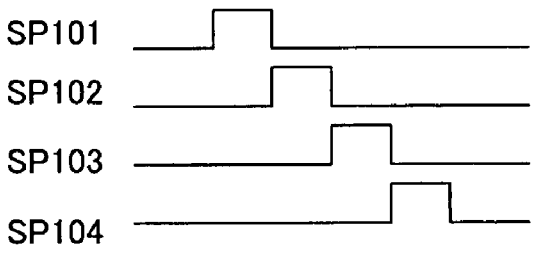

FIG. 9A
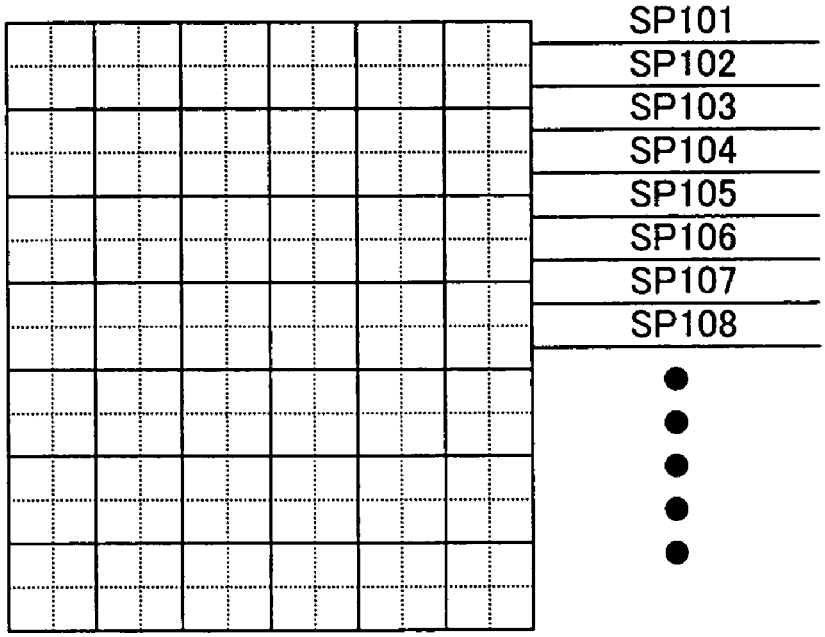
FIG. 9B
FIG. 9C
FIG. 9D
FIG. 9E
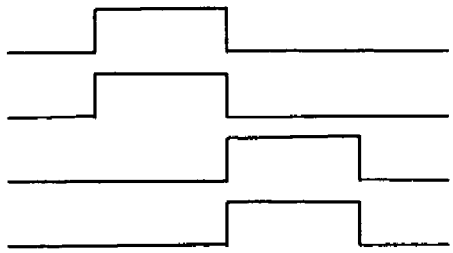

FIG. 19

| | | VGA MODE | QVGA MODE | |
|---|---|---|---|---|
| | | | Ref CIRCUIT | LOW CONSUMPTION USE CIRCUIT |
| SELECTOR SW Tr SIZE | W | 500 μm | 500 μm | 250 μm(+250 μm) |
| | L | 6 μm | 6 μm | 6 μm |
| CONSUMED POWER | | 8.5mW | 4.25mW | 2.13mW |
| SIGNAL LINE WRITING τ | | 0.88 μsec | 0.88 μsec | 1.0 μsec |
| SELECTOR FALLING τ | | 0.16 μsec | 0.16 μsec | 0.16 μsec |

DISPLAY DEVICE AND METHOD OF DRIVING SAME

BACKGROUND OF THE INVENTION

1. Field of the Invention

The present invention relates to a display device and a method of driving the same, more particularly relates to a display device able to display images corresponding to a plurality of modes having different resolutions and a method of driving the same.

2. Description of the Related Art

Display devices, for example, liquid crystal display device using liquid crystal cells for display elements of pixels (electro-optical elements), are being used in a wide range of electronic devices, for example, personal digital assistants (PDA), mobile phones, digital cameras, video cameras, and personal computer display devices taking advantage of their characteristic features of thin shape and low power consumption.

FIG. 1 is a block diagram of an example of the configuration of a liquid crystal display device. A liquid crystal display device 1 has, as shown in FIG. 1, an effective pixel portion 2, a vertical drive circuit (VDRV) 3, and a horizontal drive circuit (HDRV) 4.

The effective pixel portion 2 has a plurality of pixel circuits 21 arranged in a matrix. Each pixel circuit 21 is constituted by a thin film transistor (TFT) 21 as a switching element, a liquid crystal cell LC 21 having a pixel electrode connected to a drain electrode (or a source electrode) of the TFT 21, and a storage capacitor Cs21 having one electrode connected to the drain electrode of the TFT 21. Corresponding to these pixel circuits 21, scan lines 5-1 to 5-m are arranged for every row along a pixel arrangement direction and signal lines 6-1 to 6-n are arranged for every column along the pixel arrangement direction. Gate electrodes of the TFTs 21 of the pixel circuits 21 are connected to the same scan lines 5-1 to 5-m in units of rows. Further, source electrodes (or drain electrodes) of the pixel circuits 21 are connected to the same signal lines 6-1 to 6-n in units of columns. In a general liquid crystal display device, a storage capacitor interconnect Cs is independently laid and storage capacitors Cs21 are formed between the storage capacitor interconnect and the connection electrodes. The storage capacitor interconnect Cs receives as input a same phase pulse as a common voltage VCOM. The other electrodes of the storage capacitors Cs21 of the pixel circuits 21 are connected to a supply line 7 of the common voltage VCOM inverting in polarity with every horizontal scan period (1H).

The scan lines 5-1 to 5-m are driven by the vertical drive circuit 3, while the signal lines 6-1 to 6-n are driven by the horizontal drive circuit 4.

The vertical drive circuit 3 performs processing for scanning in the vertical direction (row direction) every field period and successively selecting the pixel circuits 21 connected to the scan lines 5-1 to 5-m in units of rows. Namely, when the vertical drive circuit 3 gives the scan line 5-1 a scan pulse SP1, the pixels of the columns of the first row are selected, while when it gives the scan line 5-2 a scan pulse SP2, pixels of the columns of the second row are selected. In the same way after this, it successively gives the scan lines 5-3, . . . , 5-m the scan pulses SP3, . . . , SPm.

FIG. 2 is a circuit diagram of an example of the configuration of a vertical drive circuit of a general liquid crystal display device. Note that, in FIG. 2, a circuit for driving the odd number row (for example, the first row) scan line 5-1 and the next even number row (for example, the second row) scan line 5-2 is shown as an example.

This vertical drive circuit 3 has, as shown in FIG. 2, shift registers (S/R) 31 and 32 equipped with level shifters, sampling latches (EnbSML) 33 and 34, and negative power supply level shifters 35 and 36.

FIGS. 3A to 3F are timing charts of the circuit of FIG. 2. FIG. 3A shows a common voltage VCOM supplied to the other electrode of the storage capacitor Cs21 of each pixel PXL and having a polarity inverting for every horizontal scan period (1H); FIG. 3B shows a vertical clock VCK serving as a reference of the vertical scan; FIG. 3C shows an output signal S31 of the shift register 31; FIG. 4D shows an output signal S32 of the shift register 32; FIG. 4E shows an output signal S35 of the negative power supply level shifter 35; and FIG. 3F shows an output signal S36 of the negative power supply level shifter 36.

The shift registers 31 and 32 are supplied with a vertical start pulse VST instructing the start of a vertical scan and vertical clocks VCK and VCKX having inverse phases to each other and serving as references of a vertical scan generated by a not illustrated clock generator. For example, the vertical clock VCK is supplied to the shift registers 31 and 32 as a clock having an amplitude of 0-3.3V, but the shift registers 31 and 32 perform level shift operations from 3.3V to 7.3V. Further, the sampling latches 33 and 34 receive a common enable signal enb/xenb as shown in FIG. 2 and sample and latch the output signals S31 and S32 of the shift registers 31 and 32. Here, the periods where the adjacent scan lines are turned on and off are prevented from overlapping by setting a predetermined interval between a falling timing of the drive signal of a previous stage (odd number stage) and a rising timing of the drive signal of a latter stage (even number stage). The negative power supply level shifters 35 and 36 are connected to one end sides of the scan lines 5-1 and 5-2, receive the latch signals of the sampling latches 33 and 34, and successively supply the drive signals S35 and S36 as scan pulses of for example about 7.3V to the scan lines 5-1 and 5-2. Further, the negative power supply level shifters 35 and 36 supply the drive signals S35 and S36 level shifted from 0V to −4.8V to the scan lines 5-1 and 5-2 to reliably turn off the TFT 21 of the pixel circuit 221 at the time of non-selection. As shown in FIGS. 3A to 3F, in the horizontal scan period where the common voltage VCOM is a high level, the odd number row scan line 5-1 is driven, while in the horizontal scan period where the common voltage VCOM is a low level, the even number row scan line 5-2 is driven. In this way, for every horizontal scan period, the first row scan line 5-1 to the m-th row scan line 5-m are successively driven.

The horizontal drive circuit 4 is a circuit for level shifting selector pulses SEL and XSEL supplied by a not illustrated clock generator and write input a video signal into the pixel circuits line by line.

Further, a horizontal drive circuit in a liquid crystal display device using for example low temperature polycrystalline silicon, as shown in FIG. 4, is provided with a selector 8 having selector switches 81-R, 81-G, 81-B, . . . , 84-R, 84-G, 84-B, . . . , (8n-R, 8n-G, 8n-B), uses the selector switches to select data signals SDT1 to SDT4, . . . to be written into the pixel circuits 21, and supplies them to the signal lines 6-1 to 6-n to draw an image. A liquid crystal display device successively supplies the three primary color R (red) data, G (green) data, and B (blue) data to the signal lines, specifically, first supplies the R data to the signal lines 6-1 to 6-n, then supplies the G data to the signal lines 6-1 to 6-n, and finally supplies the B data to the signal lines 6-1 to 6-n to write them in the pixel circuits 21 and draw the images. Accordingly, each of the signal lines 6-1 to 6-n has three selector switches connected to it. FIG. 4 shows a state where only the selector switches 81-R to 84-R corresponding to R are turned on. When the R data finishes being written, only the selector switches 81-G to 84-G corresponding to G are turned ON and the G data is written. When the G data finishes being written, only the selector switches 81-B to 84-B corresponding to B are turned ON and the B data is written.

The selector switches 81-R, 81-G, 81-B, . . . , 84-R, 84-G, 84-B, . . . , (8n-R, 8n-G, 8n-B) of the selector 8 are configured by, as shown in FIG. 5, transfer gates TMG-R, TMG-G, and TMG-B connecting sources and drains of p-channel MOS (PMOS) transistors and n-channel MOS (NMOS) transistors. The transfer gates are controlled in conduction by select signals SEL1 and XSEL1, SEL2 and XSEL2, and SEL3 and XSEL3 taking complementary levels. Specifically, the transfer gates TMG-R configuring the R data selector switches 81-R to 84-R are controlled in conduction by the select signals SELL and XSEL1. The transfer gates TMG-G configuring the G data selector switches 81-G to 84-G are controlled in conduction by the select signals SEL2 and XSEL2. The transfer gates TMG-B configuring the B data selector switches 81-B to 84-B are controlled in conduction by the select signals SEL3 and XSEL3.

FIG. 6 is a view of an example of the configuration of the drive circuit of a transfer gate TMG(-R) of the selector 8. This transfer gate drive circuit 9 is configured by a level shifter 91 for shifting the levels of the select signals SEL and XSEL from an external circuit (IC) from −2.7V to 7.3V and buffers 92 and 93 connecting for example two CMOS inverters in series.

Summarizing the problem to be solved by the invention, in recent years, PDAs and other portable terminals have increasingly been required to mount high definition display panels, for example, display panels for display in a VGA mode (640×480) able to give a high definition image quality when viewing photographs or other graphic images.

When operating the above liquid crystal display device in the VGA mode, since the vertical drive circuit 3 only has outputs corresponding to the number of pixels one-to-one and has a fixed resolution, it is necessary to mount a vertical drive circuit corresponding to the VGA mode. However, a PDA etc. has many applications such as schedule management which do not require high definition display, for example, where display in the QVGA mode (320×240) is sufficient. Regardless of this, it is necessary to drive it in the VGA mode having a high clock frequency at the time of operation, therefore power ends up being wastefully consumed.

Further, when realizing a liquid crystal display device of the VGA mode, the load in the panel, particularly the capacity and load of the signal lines, increases in comparison with the QVGA mode. Therefore, as shown in FIG. 6, it is necessary to enlarge the sizes of the transistors configuring the transfer gates serving as the selector switches of the selector 8 of the horizontal drive circuit 4 and enlarge sizes of the transistors configuring the buffers 92 and 93 of the transfer gate drive circuit 9 to enlarge the driving capability. In this case as well, however, in the same way as the vertical drive circuit, despite a PDA etc. having many applications such as schedule management which do not require high definition display, for example, where display in the QVGA mode (320×240) is sufficient, use is made of transfer gates and buffers having transistor sizes enlarged in the driving capability so as to handle the VGA mode, so power ends up being wastefully consumed.

SUMMARY OF THE INVENTION

An object of the present invention is to provide a display device able to select a driving capability corresponding to a plurality of resolutions, able to be driven in accordance with the purpose, and able to realize a lower power consumption and a method of driving the same.

To attain the above object, according to a first aspect of the present invention, there is provided a display device having at least a different resolution first mode and second mode having a lower resolution than the first mode, comprising a pixel portion comprised of pixel circuits, for writing pixel data into pixel cells through switching elements, arranged so as to form a matrix of at least a plurality of rows; a plurality of scan lines arranged so as to correspond to a row arrangement of the pixel circuits and controlling conduction of the switching elements; at least one signal line arranged so as to correspond to a column arrangement of the pixel circuits and propagating the pixel data; and a vertical drive circuit for processing for successively scanning the scan lines in a row direction by scan pulses and successively selecting the pixel circuits connected to the scan lines in units of rows in the first mode and for processing for successively scanning the scan lines for every adjacent plurality of scan lines in the row direction by the scan pulses and successively selecting the pixel circuits connected to the plurality of scan lines in units of the plurality of rows in the second mode.

Preferably, the vertical drive circuit sets a rear edge timing of the scan pulses for outputting the scan pulses to be output to a plurality of scan lines to be scanned simultaneously in parallel to the scan lines of a previous stage earlier than the rear edge timing of the scan pulses to be output to the scan lines of the next stage in the second mode.

Preferably, the display device further has a horizontal drive circuit including a selector having selector switches for selecting the pixel data and supplying the same to the signal lines, the selector switches formed by connecting pluralities of switches in parallel to the corresponding signal lines, making the pluralities of switches conductive and outputting the selected pixel data to the signal lines through the pluralities of switches in the first mode, and making any switches among the pluralities of switches conductive and outputting the selected pixel data to the signal lines through the switches in the second mode.

Preferably, the display device has a plurality of the signal lines and has a plurality of horizontal drive circuits dividing the plurality of signal lines into a plurality of groups and supplying pixel data to the signal lines corresponding to the divided groups.

Accordingly to a second aspect of the present invention, there is provided a method of driving a display device including a pixel portion comprised of pixel circuits, for writing pixel data into pixel cells through switching elements, arranged so as to form a matrix of at least a plurality of rows and a plurality of scan lines arranged so as to correspond to the row arrangement of the pixel circuits and for controlling the conduction of the switching elements, comprising the steps of processing for successively scanning the scan lines in the row direction by scan pulses and successively selecting the pixel circuits connected to the scan lines in units of rows in a first mode having a predetermined resolution and processing for successively scanning the scan lines for every adjacent plurality of scan lines in the row direction by the scan pulses and successively selecting the pixel circuits connected to the plurality of scan lines in units of the plurality of rows in a second mode having a lower resolution than the first mode.

Preferably, the method further comprises setting a rear edge timing of the scan pulses for outputting the scan pulses to be output to a plurality of scan lines to be scanned simultaneously in parallel to the scan lines of a previous stage earlier than the rear edge timing of the scan pulses to be output to the scan lines of the next stage in the second mode.

Preferably, the pixel cells are liquid crystal cells.

According to the present invention, in for example the first mode having a high resolution, the vertical drive circuit successively scans the scan lines in the row direction by the scan pulses and successively selects the pixel circuits connected to the scan lines in units of rows. Further, in the second mode having a lower resolution than the first mode, the vertical drive circuit successively scans every adjacent plurality of scan lines in the row direction by the scan pulses and successively selects the pixel circuits connected to the plurality of scan lines in units of the plurality of rows. Further, in the first mode, the selector of the horizontal drive circuit makes a plurality of switches conductive and outputs the selected pixel data to the signal lines through the plurality of switches. In the second mode, the selector of the horizontal drive circuit makes any switches among the plurality of switches conductive and outputs the selected pixel data to the signal lines through the switches.

BRIEF DESCRIPTION OF THE DRAWINGS

These and other objects and features of the present invention will become clearer from the following description of the preferred embodiments given with reference to the attached drawings, wherein:

FIGS. 8A to 8E are schematic views for explaining the method of driving in a VGA mode of a vertical drive circuit of FIG. 7;

FIGS. 9A to 9E are schematic views for explaining the method of driving in a QVGA mode of a vertical drive circuit of FIG. 7;

FIG. 19 is a view of results of simulation of the power consumption of a selector of a horizontal drive circuit according to the present embodiment.

DESCRIPTION OF PREFERRED EMBODIMENTS

Below, a preferred embodiment of the present invention will be explained in detail with reference to the drawings.

Figure 1:
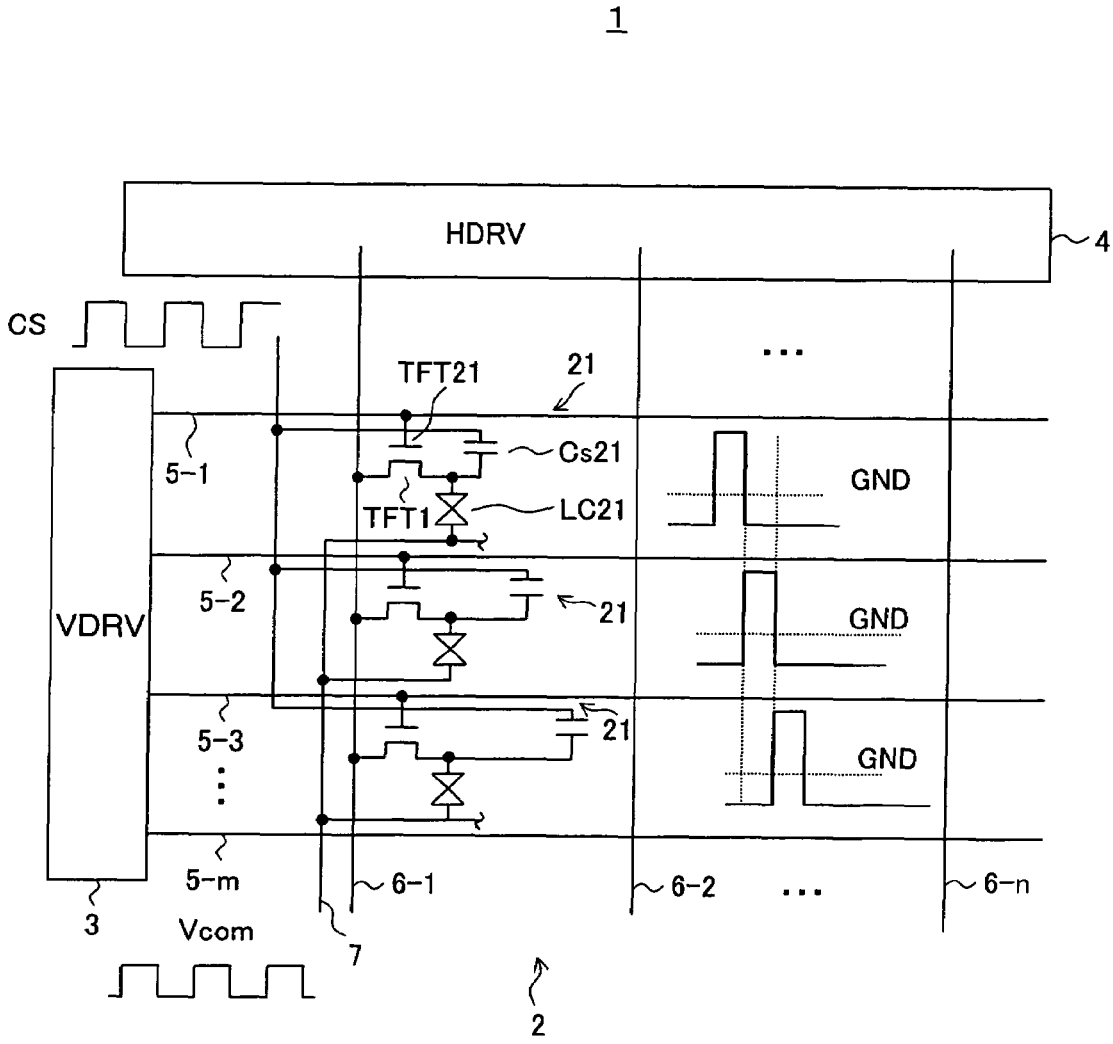
FIG. 1 is a block diagram of an example of the configuration of a general liquid crystal display device.
Figure 2:
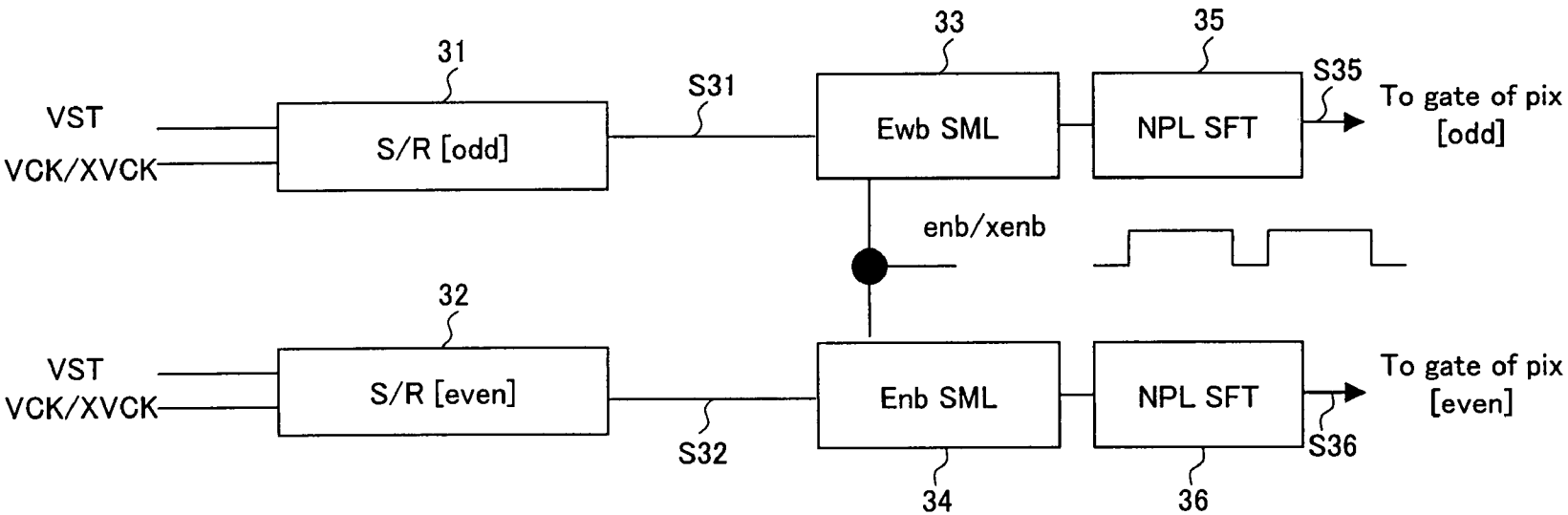
FIG. 2 is a circuit diagram of the configuration of a conventional vertical drive circuit.
Figures 3A, 3B, 3C, 3D, 3E, 3F:
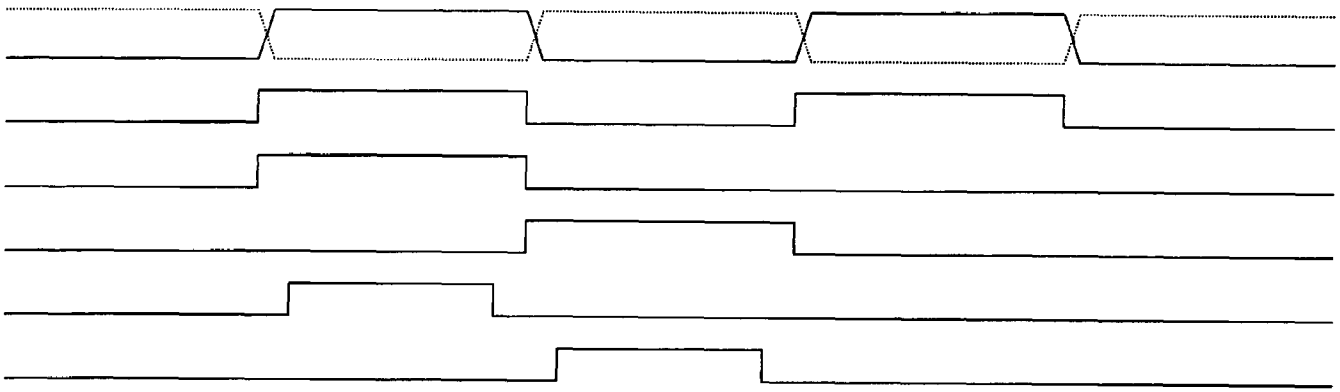
FIGS. 3A to 3F are timing charts of principal parts of the circuit of FIG. 2.
Figure 4:
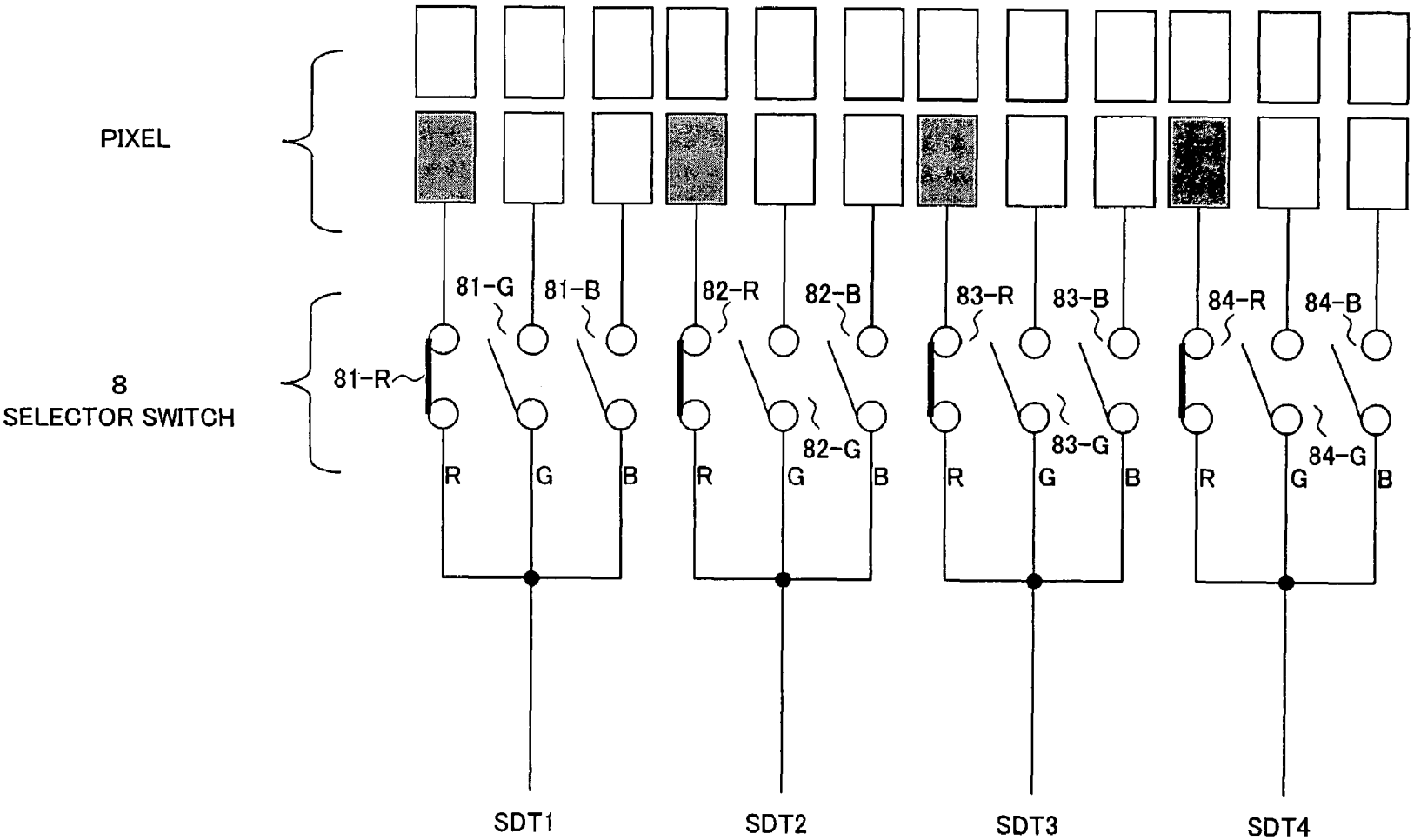
FIG. 4 is a schematic view of the configuration of a selector of a horizontal drive circuit.
Figure 5:
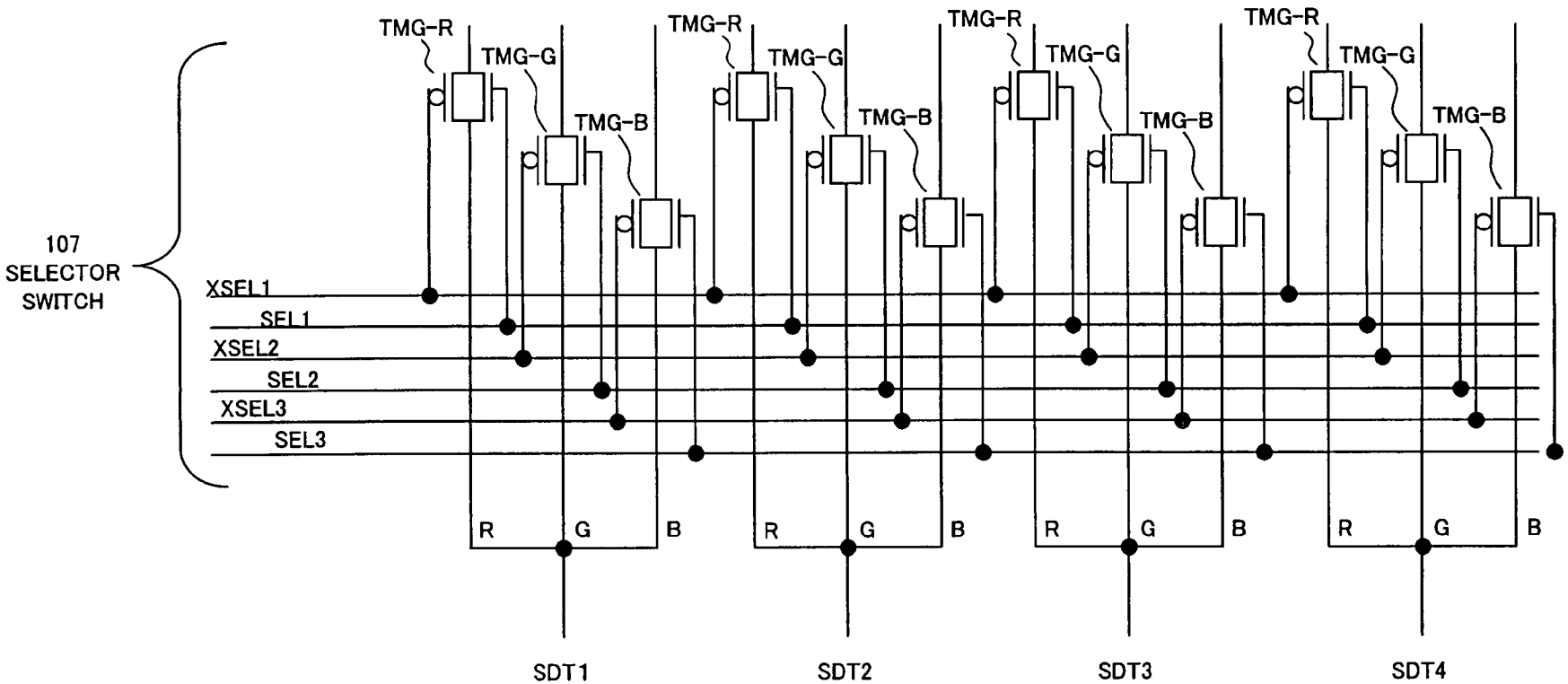
FIG. 5 is a circuit diagram of a concrete example of the configuration of a selector of a horizontal drive circuit.
Figure 6:
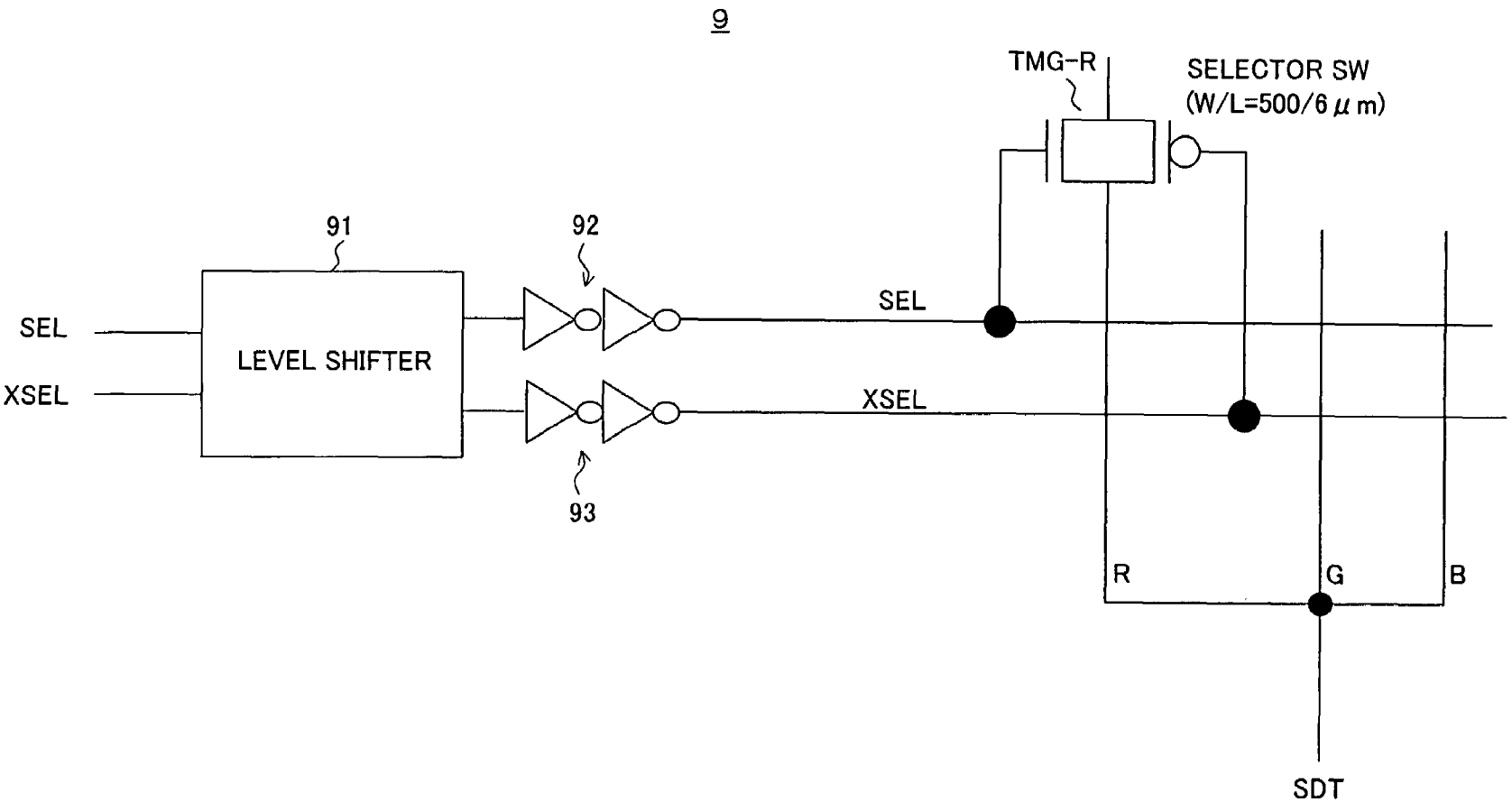
FIG. 6 is a view of an example of the configuration of a drive circuit of a transfer gate of the selector of FIG. 5.
Figure 7:
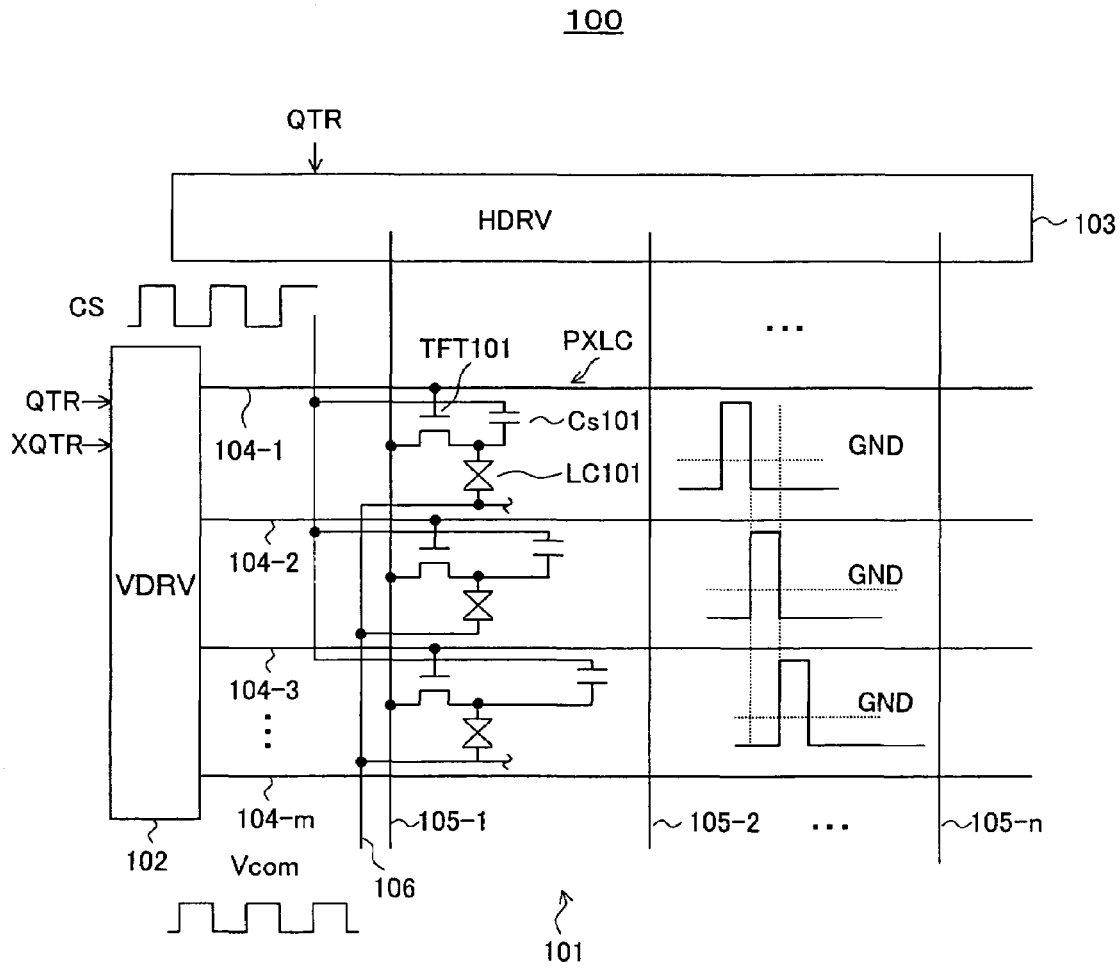
FIG. 7 is a view of an example of the configuration of a liquid crystal display device according to an embodiment of the present invention.

FIG. 7 is a view of an example of the configuration of a liquid crystal display device according to an embodiment of the present invention using for example liquid crystal cells as the display elements of the pixels (electro-optical elements). A liquid crystal display device 100 according to the present embodiment is configured so as to enable selection of its driving capability in accordance with two modes of resolutions, that is, the two modes of a VGA mode (640×480) as the first mode and a QVGA mode (320×240) as the second mode.

The liquid crystal display device 100 has, as shown in FIG. 7, an effective pixel portion 101, a vertical drive circuit (VDRV) 102, and a horizontal drive circuit (HDRV) 103.

The effective pixel portion 101 has a plurality of pixel circuits PXLC arranged in a matrix. Specifically, 640×480 pixel circuits are arranged corresponding to the VGA mode. Each pixel circuit PXCL is configured by a TFT 101 serving as a switching element, a liquid crystal cell LC101 having a pixel electrode connected to the drain electrode (or the source electrode) of the TFT 101, and a storage capacitor Cs101 having one electrode connected to the drain electrode of the TFT 101. Corresponding to these pixel circuits PXLC, scan lines 104-1 to 104-m are arranged for every row along the pixel arrangement direction and signal lines 105-1 to 105-n are arranged for every column along the pixel arrangement direction. The gate electrodes of the TFTs 101 of the pixel circuits PXLC are connected to the same scan lines 104-1 to 104-m in unit of rows. Further, the source electrodes (or drain electrodes) of the pixel circuits PXLC are connected to the same signal lines 105-1 to 105-n in units of columns. Further, in a general liquid crystal display device, a storage capacitor interconnect Cs is independently laid and storage capacitors Cs101 are formed between the storage capacitor interconnect and the connection electrodes. The storage capacitor interconnect Cs receives as input a same phase pulse as a common voltage VCOM. The other electrodes of the storage capacitors Cs101 of the pixel circuits PXLC are connected to a supply line 106 of the common voltage VCOM inverting in polarity with every horizontal scan period (1H) or two horizontal scan periods (2H).

The scan lines 104-1 to 104-m are driven by the vertical drive circuit 102, while the signal lines 105-1 to 105-n are driven by the horizontal drive circuit 103.

When receiving the inverse mode signal QTR at the high level and XQTR at the low level, the vertical drive circuit 102 decides the mode is the VGA mode and performs processing for scanning in the vertical direction (row direction) for every field period and successively selecting the pixel circuits PXLC connected to the scan lines 104-1 to 104-m in units of rows. Namely, as shown in FIGS. 8A to 8E, the vertical drive circuit 102 gives a scan pulse SP101 to the scan line 104-1 to select the pixels of the columns of the first row and gives a scan pulse SP102 to the scan line 104-2 to select the pixels of the columns of the second row. Below, in the same way as above, it successively gives scan pulses SP103, . . . , SP10m to the scan lines 104-3, . . . , 104-m. In this VGA mode, the common voltage VCOM has a polarity inverted for every horizontal scan period (1H).

When receiving the inverse phase mode signal QTR at the low level and XQTR at the low level, the vertical drive circuit 102 decides the mode is the QVGA mode and performs processing for scanning in the vertical direction (row direction) for every two field periods and successively selecting the pixel circuits PXLC connected to the scan lines 104-1 to 104-m in units of two rows. Namely, as shown in FIGS. 9A to 9E, the vertical drive circuit 102 simultaneously gives the scan pulses SP101 and SP102 to the scan line 104-1 and the scan line 104-2 to select the pixels of the columns of the first row and the second row and gives scan pulses SP103 and SP104 to the scan line 104-3 and the scan line 104-4 to select the pixels of the columns of the third row and the fourth row. Below, in the same way as above, it successively gives scan pulses SP10m-1 and SP10m to the scan lines 104-m-1 and 104-m. In this QVGA mode, the common voltage VCOM has a polarity inverted for every two horizontal scan periods (2H).

Figure 10:
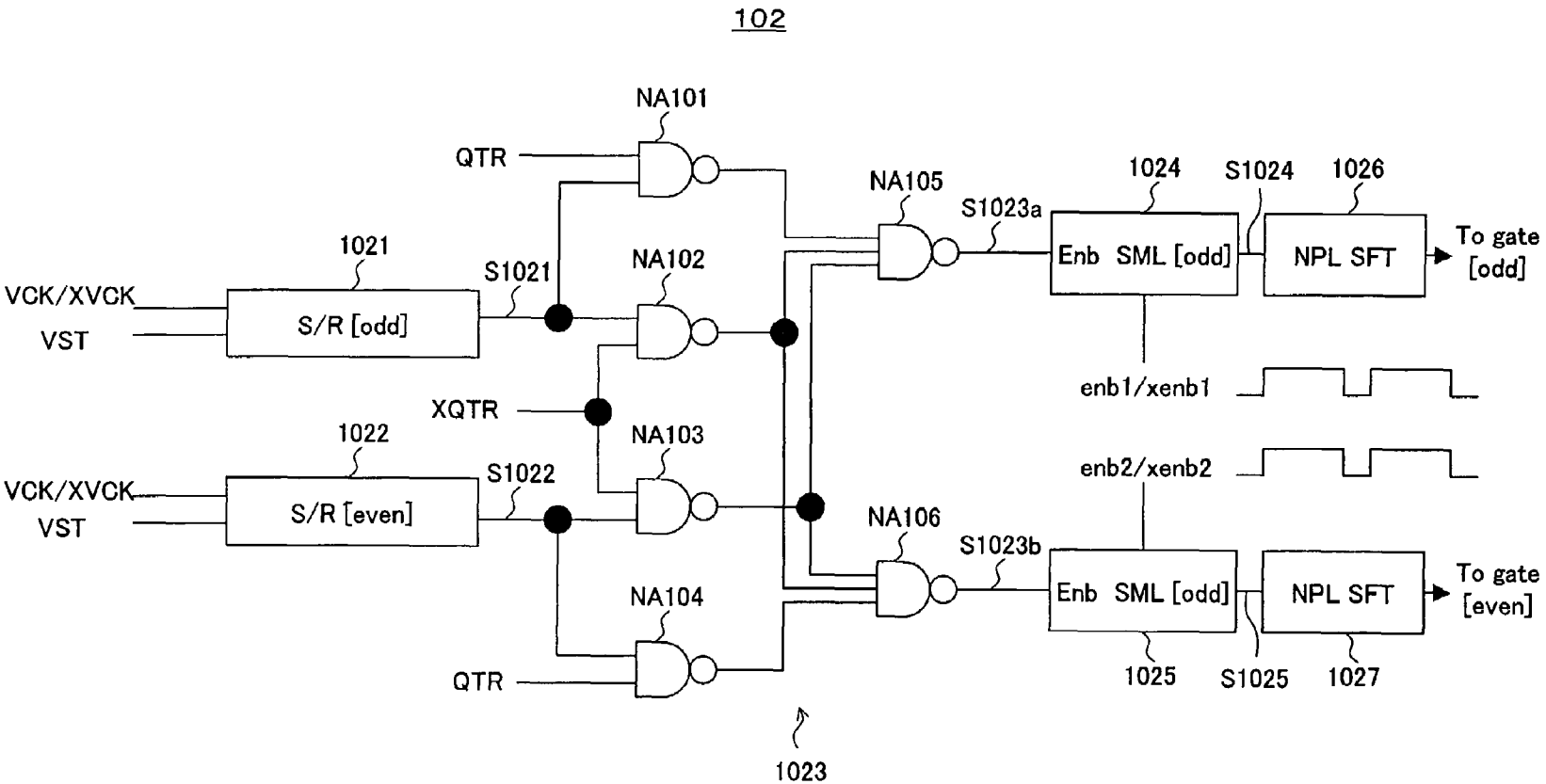
FIG. 10 is a circuit diagram of an example of the configuration of a vertical drive circuit according to the embodiment.

FIG. 10 is a circuit diagram of an example of the configuration of a vertical drive circuit according to the present embodiment. Note that FIG. 10 shows a circuit for driving the odd number row (for example first row) scan line 104-1 and the next stage even number row (for example the second row) scan line 104-2 as an example.

This vertical drive circuit 102 has, as shown in FIG. 10, shift registers (S/R) 1021 and 1022 equipped with level shifters, a switch circuit 1023, sampling latches (EnbSML) 1024 and 1025, and negative power supply level shifters (NPLSFT) 1026 and 1027.

The shift registers 1021 and 1022 are supplied with a vertical start pulse VST for instructing the start of the vertical scan and vertical clocks VCK and VCKX having inverse phases to each other and serving as the reference of the vertical scan all generated by a not illustrated clock generator. For example, the vertical clock VCK is supplied to the shift registers 31 and 32 as a clock having an amplitude of 0-3.3V. The shift register 1021 performs a level shift operation from 3.3V to 7.3V and outputs a signal S1021 to the switch circuit 1023. The shift register 1022 performs a level shift operation from 3.3V to 7.3V and outputs a signal S1022 delayed from the output signal S1021 of the shift register 1021 by the amount of 1 horizontal scan period to the switch circuit 1023.

When the mode signals QTR and XQTR indicate the VGA mode, the switch circuit 1023 receives the output signal S1021 of the shift register 1021 and the output signal S1022 of the shift register 1022 and outputs the signals S1021 and S1022 as the signals S1023*a* and S1023*b* to the sampling latches 1024 and 1025 while maintaining the difference at the time of the input, that is, while maintaining the delay of the signal S1022 from the signal S1021 of 1 horizontal scan period as it is.

When the mode signals QTR and XQTR indicate the QVGA mode, the switch circuit 1023 receives the output signal S1021 of the shift register 1021 and the output signal S1022 of the shift register 1022, generates pulses obtained by combining the signals S1021 and S1022, and outputs them as the signals S1023*a* and S1023*b* to the sampling latches 1024 and 1025.

The switch circuit 1023 has, as shown in FIG. 10, 2-input NAND circuits NA101 to NA104 and 3-input NAND circuits NA105 and NA106. A first input terminal of the NAND circuit NA101 is connected to the supply line of the mode signal QTR, a second input terminal is connected to the output line of the signal S1021 of the shift register 1021, and the output terminal is connected to the first input terminal of the NAND circuit NA105. The first input terminal of the NAND circuit NA102 is connected to the output line of the signal S1021 of the shift register 1021, the second input terminal is connected to the supply line of the mode signal XQTR, and the output terminal is connected to the second input terminal of the NAND circuit NA105 and the first input terminal of the NAND circuit NA106. The first input terminal of the NAND circuit NA103 is connected to the output line of the signal S1022 of the shift register 1022, the second input terminal is connected to the supply line of the mode signal XQTR, and the output terminal is connected to the third input terminal of the NAND circuit NA105 and the second input terminal of the NAND circuit NA106. The first input terminal of the NAND circuit NA104 is connected to the supply line of the mode signal QTR, the second input terminal is connected to the output line of the signal S1022 of the shift register 1022, and the output terminal is connected to the third input terminal of the NAND circuit NA106.

In the above configuration, when the mode signal QTR is input at the high level and the XQTR is input at the low level, the switch circuit 1023 outputs the signals S1021 and S1022 as the signals S1023*a* and S1023*b* to the sampling latches 1024 and 1025 while maintaining the difference at the time of the input, that is, while maintaining the delay of the signal S1022 from the signal S1021 of 1 horizontal scan period. Further, when the mode signal QTR is input at the low level and the XQTR is input at the high level, the switch circuit 1023 generates pulses obtained by combining the signals S1021 and S1022 and outputs them as the signals S1023*a* and S1023*b* to the sampling latches 1024 and 1025.

The sampling latch 1024 receives a first enable signal enb1/xenb1 having a certain duty ratio and samples and latches the output signal S1023*a* of the switch circuit 1023. The sampling latch 1025 receives a second enable signal enb2/xenb2 having the same cycle as the first enable signal enb1/xenb1 but having a different duty (longer high level period) as shown in FIG. 10 and samples and latches the output signal S1023*b* of the switch circuit 1023. The sampling latches 1024 and 1025 set a predetermined interval between the falling timing of the drive signal of the previous stage (odd number stage) and the rising timing of the drive signal of the latter stage (even number stage) so that the periods of turning on and off the adjacent scan lines do not overlap.

Figure 11:
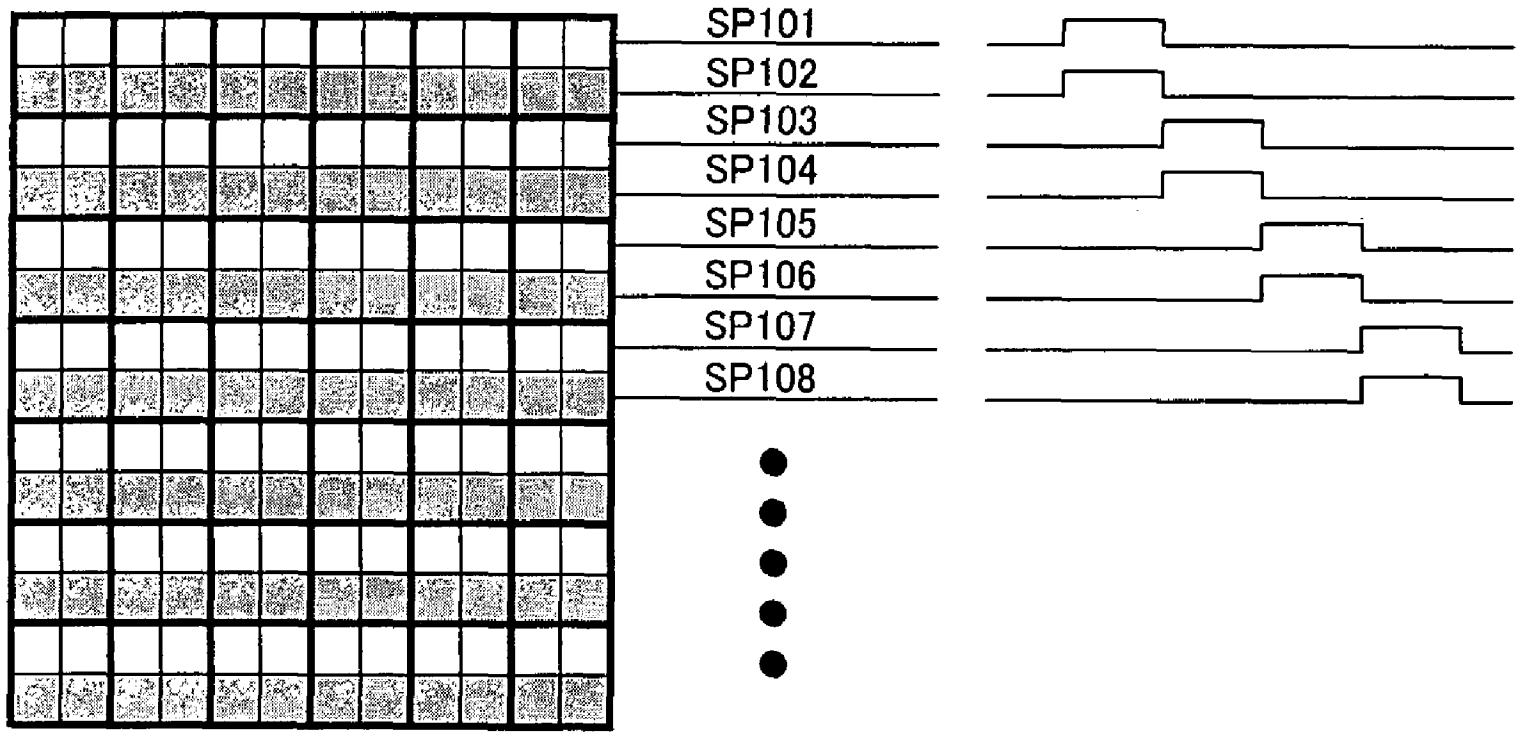
FIG. 11 is an explanatory view of horizontal streaks liable to occur in the QVGA mode.
Figure 12:
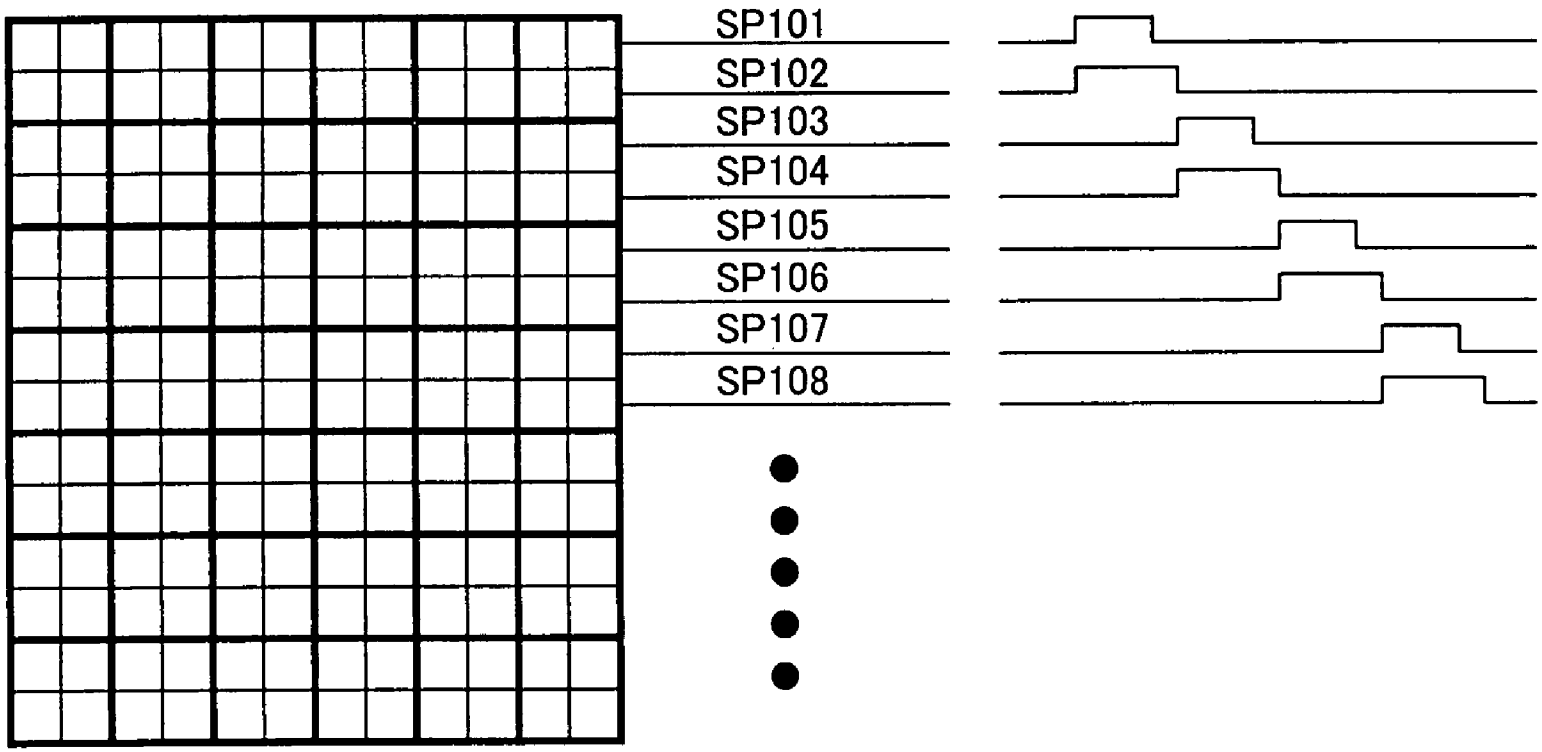
FIG. 12 is a diagram for explaining a method of driving for eliminating horizontal streaks liable to occur in the QVGA mode.

Different enable signals are separately supplied to the sampling latches 1024 and 1025 for the following reason. Namely, in both of the VGA mode and the QVGA mode, as shown in FIG. 11, in a case of only one set of the enable signal enb/xenb, horizontal streaks are generated in the even number stage depending upon the pixel layout. Therefore, as shown in FIG. 12, to make the timing of the falling of the scan pulses SP101, SP103, . . . , SP10m-1 of the odd number stages earlier than the timing of the falling of the scan pulses SP102, SP104, . . . , SP10m1 of the even number stages, in other words, by delaying the timing of the falling of the scan pulses SP102, SP104, . . . , SP10m1 of the even number stages from the timing of the falling of the scan pulses SP101, SP103, . . . , SP10m-1 of the odd number stages so as to make the coupling amounts received by the pixel circuits uniform and eliminate the horizontal streaks, use is made of a first enable signal enb1/xenb1 having a certain duty ratio and a second enable signal enb2/xenb2 having the same cycle as that of the first enable signal enb1/xenb1 but having a different duty (longer in the period of high level).

The negative power supply level shifter 1026 is connected to one end side of the odd number row scan line 104-1, receives the latch signal of the sampling latch 1024, and supplies a drive signal S1026 as a scan pulse of for example about 7.3V to the scan line 104-1. Further, the negative power supply level shifter 1026 supplies the drive signal S1026 shifted from 0V to −4.8V to the scan line 104-1 to reliably turn off the TFT 101 of the pixel circuit PXLC at the time of non-selection.

The negative power supply level shifter 1027 is connected to one end side of the even number row scan line 104-2 , receives the latch signal of the sampling latch 1025, and supplies a drive signal S1027 as the scan pulse of for example about 7.3V to the scan line 104-2. Further, the negative power supply level shifter 1027 supplies the drive signal S1027 shifted from 0V to −4.8V to the scan line 104-2 to reliably turn off the TFT 101 of the pixel circuit PXLC at the time of non-selection.

The horizontal drive circuit 4 is a circuit for shifting the levels of the selector pulses SEL and XSEL supplied by a not illustrated clock generator and writes a input video signal into the pixel circuits line by line.

Figure 13:
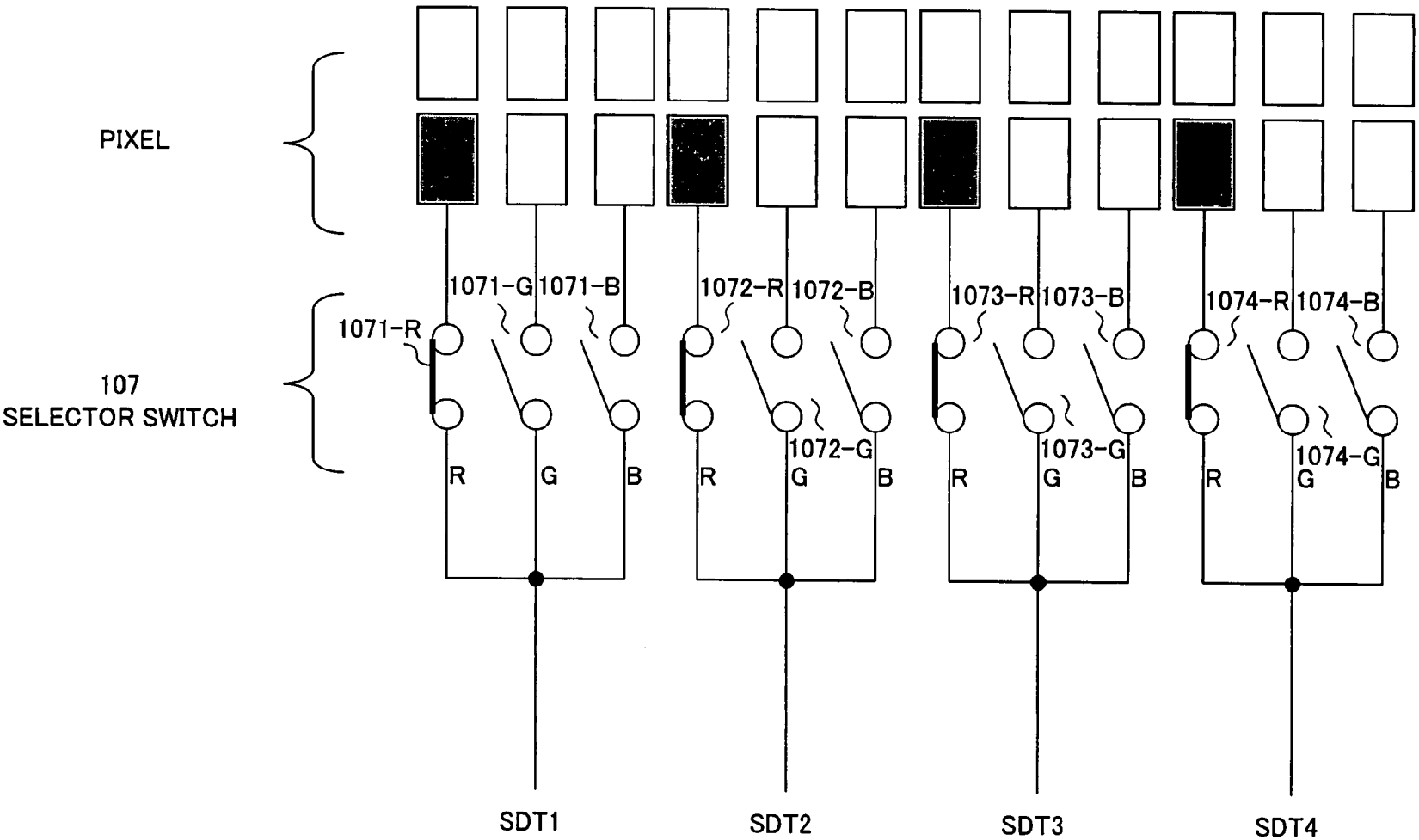
FIG. 13 is a schematic view of a selector of a horizontal drive circuit according to the embodiment.

Further, the horizontal drive circuit 103 is provided with, as shown in FIG. 13, a selector 107 having selector switches 1071-R, 1071-G, 1071-B, . . . , 1074-R, 1074-G, 1074-B, . . . , (107n-R, 107n-G, 107n-B), selects data signals SDT101 to SDT104 . . . to be written into the pixel circuits PXLC by the selector switches, and supplies the same to the signal lines 105-1 to 105-n to draw images. The liquid crystal display device 100 successively supplies the three primary color R (red) data, G (green) data, and B (blue) data to the signal lines, specifically, first supplies the R data to the signal lines 105-1 to 105-n, then supplies the G data to the signal lines 105-1 to 105-n, and finally supplies the B data to the signal lines 105-1 to 105-n to write them in the pixel circuits PXLC and draw the images. Accordingly, each of the signal lines 105-1 to 105-n has three selector switches connected to it. FIG. 13 shows a state where only the selector switches 1071-R to 1074-R corresponding to R are turned on. When the R data finishes being written, only the selector switches 1071-G to 1074-G corresponding to G are turned ON and the G data is written. When the G data finishes being written, only the selector switches 1071-B to 1074-B corresponding to B are turned ON and the B data is written.

Figure 14:
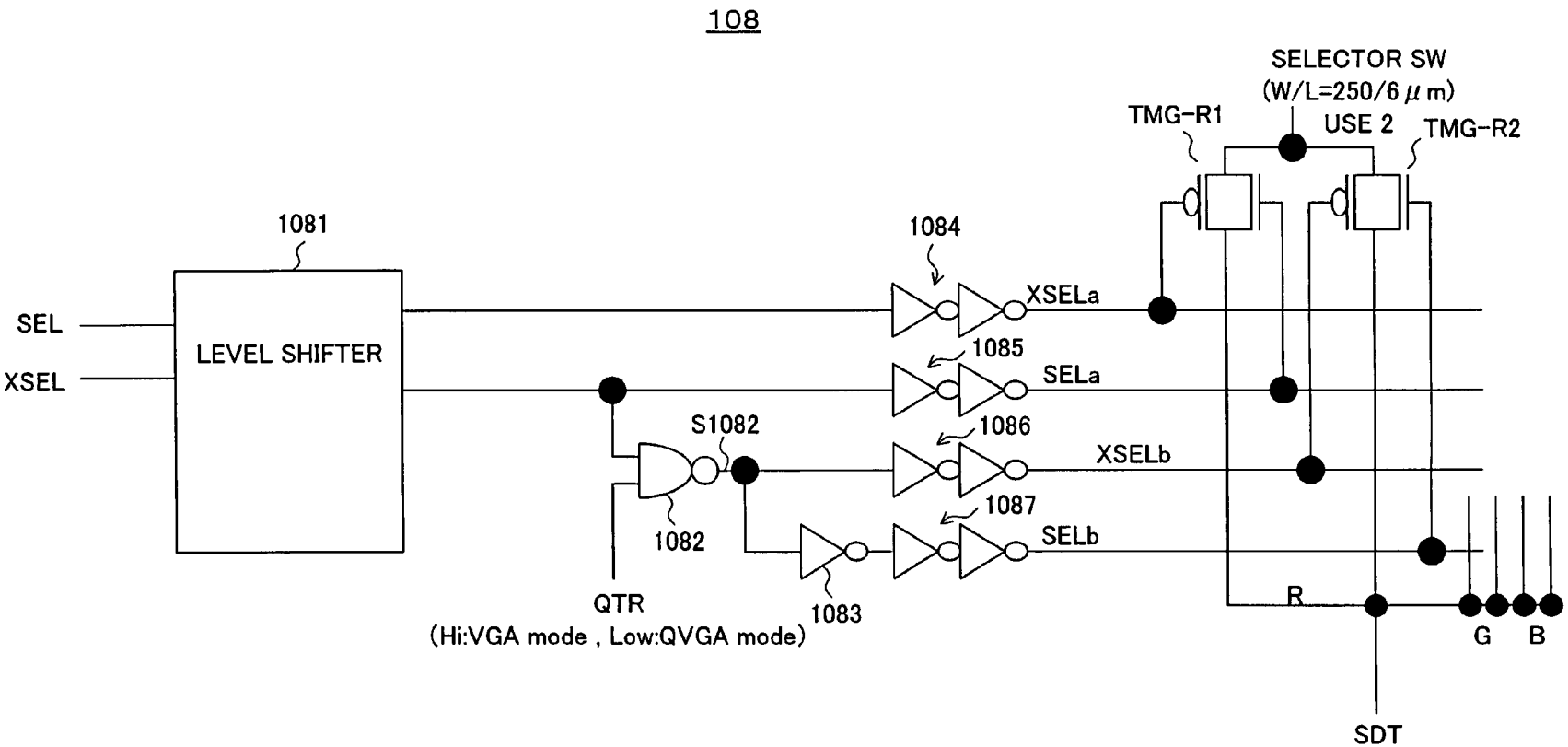
FIG. 14 is a circuit diagram of an example of the configuration of a transfer gate drive circuit of a selector of a horizontal drive circuit according to the embodiment.

The selector switches 1071-R, 1071-G, 1071-B, . . . , 1074-R, 1074-G, 1074-B, . . . , (107n-R, 107n-G, 107n-B) of the selector 107 are configured by transfer gates TMG-R1, TMG-R2, TMG-G1, TMG-G2, TMG-B1, and TMG-B2 connecting sources and drains of the PMOS transistors and NMOS transistors as shown in FIG. 14. Namely, in each selector switch, for example a pair of transfer gates TMG-R1 and TMG-R2 having the same transistor size are connected in parallel with respect to the signal line. Drive control is performed to drive the signal line using both transfer gates TMG-R1 and TMG-R2 for manifesting the driving capability to the maximum in the VGA mode and to drive the signal line using only one transfer gate TMG-R1 in the QVGA mode. Note that FIG. 14 only shows the R data transfer gates TMG-R1 and TMG-R2, but the G data transfer gates and B data transfer gates are also configured by sets of the G data transfer gates TMG-G1 and TMG-G2 and the B data transfer gates TMG-B1 and TMG-B2 in the same way as above.

The transfer gates are controlled in conduction by the select signals SEL101 and XSEL101, SEL102 and XSEL102, and SEL103 and XSEL103 taking complementary levels. Specifically, the transfer gates TMG-R configuring the R data selector switches 1071-R to 1074-R are controlled in conduction by the select signals SEL101 and XSEL101. The transfer gates TMG-G configuring the G data selector switches 1071-G to 1074-G are controlled in conduction by the select signals SEL102 and XSEL102. The transfer gates TMG-B configuring the B data selector switches 1071-B to 1074-B are controlled in conduction by the select signals SEL103 and XSEL103.

An example of the configuration of the drive circuit of the transfer gates TGM(-R1, -R2) of the selector 107 according to the present embodiment will be explained by FIG. 14. This transfer gate drive circuit 108 is configured by a level shifter 1081 for shifting the level of the select signals SEL and XSEL from an external circuit (IC) from −2.7V to 7.3V, a 2-input NAND circuit 1082, an inverter 1083, and buffers 1084 to 1087 obtained by connecting for example two CMOS inverters in series.

The level shifter 1081 shifts the select signals SEL and XSEL from the external circuit (IC) from −2.7V to 7.3V, outputs an active, high level select signal SEL to the first input terminal of the NAND circuit 1082 and the buffer 1085, and outputs the select signal XSEL to the buffer 1084. The NAND circuit 1082 is supplied with the mode signal QTR at the second input terminal, obtains a negative AND logic of the select signal SEL and the mode signal QTR, and outputs the result as the signal S1082 via the buffer 1086 and the inverter 1083 to the buffer 1087. The output terminal of the buffer 1084 is connected to the gate of the PMOS transistor configuring the transfer gate TMG-R1, while the output terminal of the buffer 1085 is connected to the gate of the NMOS transistor configuring the transfer gate TMG-R1. The output terminal of the buffer 1086 is connected to the gate of the PMOS transistor configuring the transfer gate TMG-R2, while the output terminal of the buffer 1087 is connected to the gate of the NMOS transistor configuring the transfer gate TMG-R2.

The NAND circuit 1082 outputs the signal S1082 at a low level when receiving the select signal SEL at the high level and receiving the mode signal QTR at the high level indicating the VGA mode. In this case, the output of the buffer 1084 becomes the low level and the output of the buffer 1085 becomes the high level, the output of the buffer 1086 becomes the low level and the output of the buffer 1087 becomes the high level, and both of the two transfer gates TMG-R1 and TMG-R2 are controlled to the conductive state.

The NAND circuit 1082 outputs the signal S1082 at a high level when receiving the select signal SEL at the high level and receiving the mode signal QTR at the low level indicating the QVGA mode. In this case, the output of the buffer 1084 becomes the low level and the output of the buffer 1085 becomes the high level, the output of the buffer 1086 becomes the high level and the output of the buffer 1087 becomes the low level, one transfer gate TMG-R1 is controlled to the conductive state, and the transfer gate TMG-R2 is controlled to the non-conductive state. Due to this, in the QVGA mode, excess power need not be consumed, and a lower power consumption is realized.

Further, timing pulses for turning on/off the transfer gates of the two selector switches are generated in the panel, so an increase of the number of input pins of the input interface is prevented.

Next, operations in the VGA mode and the QVGA mode by the above configuration will be explained in relation to FIG. 15 to FIG. 18.

Figure 15:
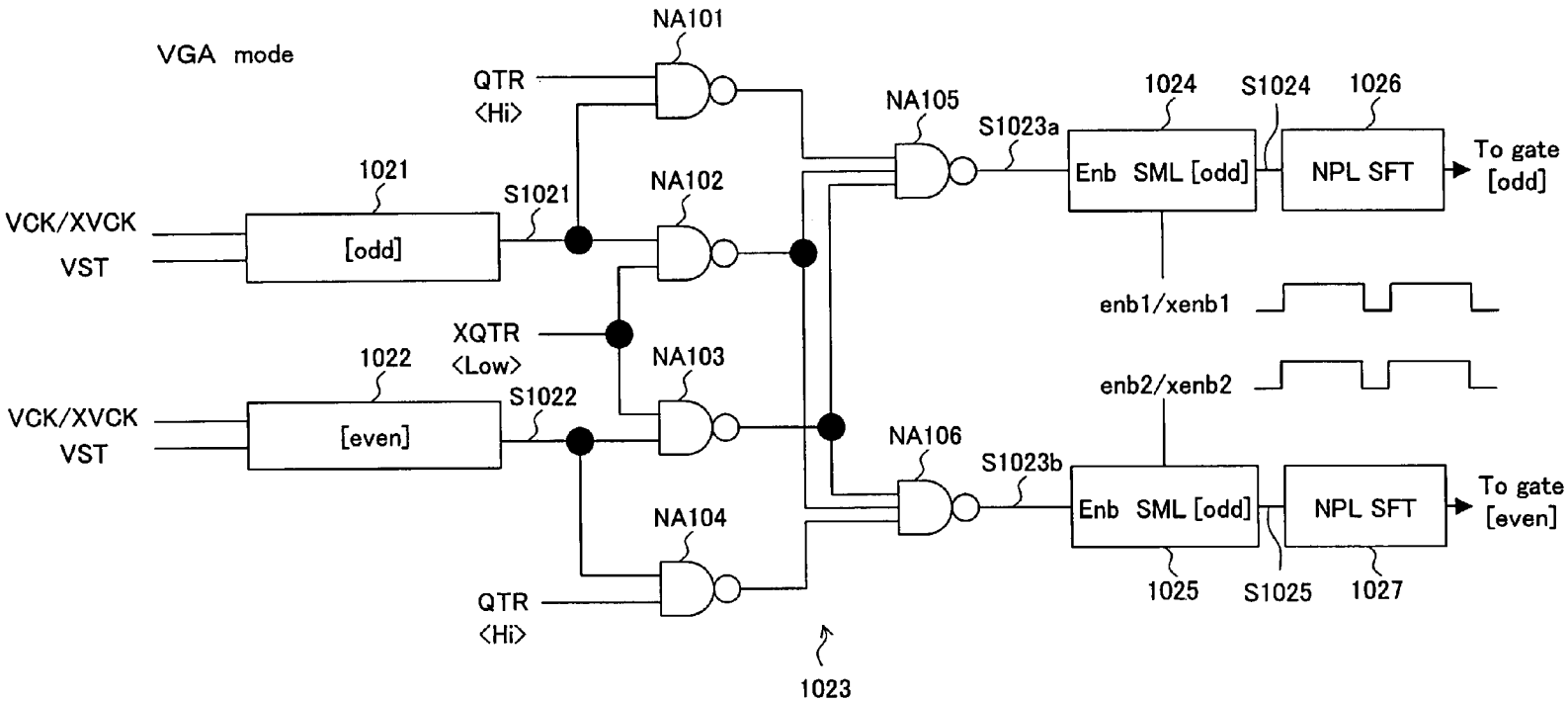
FIG. 15 is a circuit diagram of a vertical drive circuit when mode signals QTR and XQTR in the VGA mode are input.
Figures 16A, 16B, 16C, 16D, 16E, 16F, 16G, 16H:
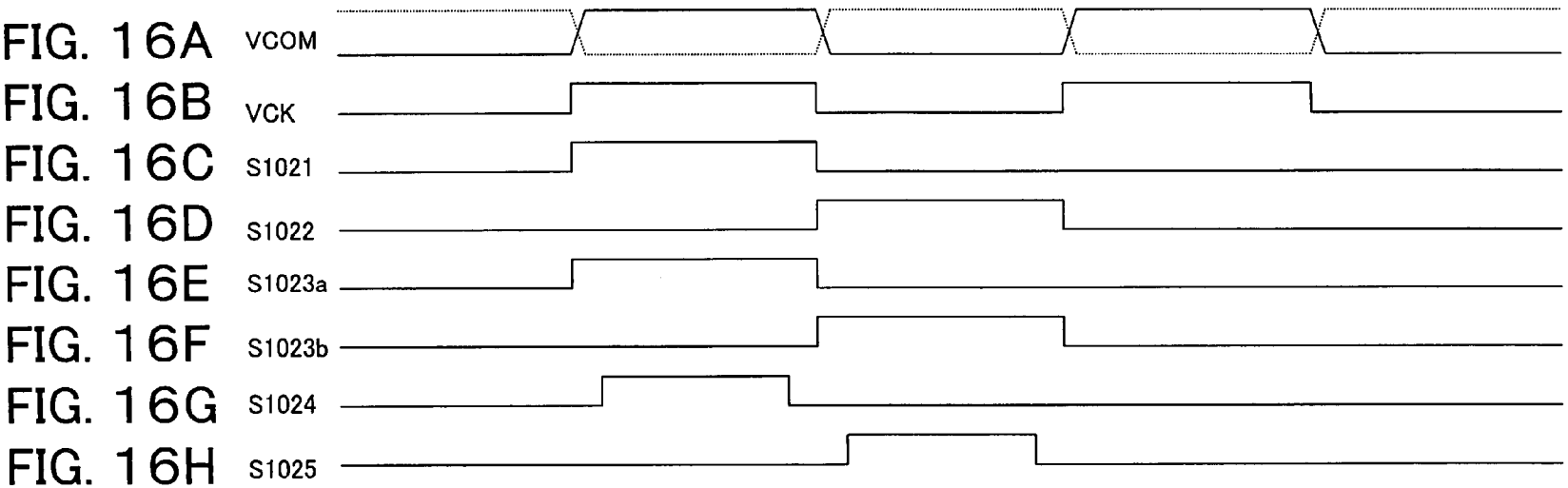
FIGS. 16A to 16H are timing charts for explaining the operation of a vertical drive circuit when mode signals QTR and XQTR are input in the VGA mode.

First, the operation in the VGA mode will be explained in relation to FIG. 15 and FIGS. 16A to 16H. FIG. 15 is a circuit diagram of the vertical drive circuit 102 when the mode signals QTR and XQTR in the VGA mode are input. FIG. 16A shows the common voltage VCOM having a polarity inverting for every horizontal scan period (1H) supplied to the other electrode of the storage capacitor Cs101 of each pixel circuit PXLC; FIG. 16B shows the vertical clock VCK serving as the reference of the vertical scan; FIG. 16C shows an output signal S1021 of the shift register 1021; FIG. 16D shows the output signal S1022 of the shift register 1022; FIG. 16E shows the output signal S1023*a* of the switch circuit 1023; FIG. 16F shows the output signal S1023*b* of the switch circuit 1023; FIG. 16G shows the output signal S1024 of the sampling latch 1024; and FIG. 16H shows the output signal S1025 of the sampling latch 1025.

In the VGA mode, the mode signal QTR is input at a high level to the switch circuit 1023 of the vertical drive circuit 102 and the horizontal drive circuit 103, and the inverted mode signal XQTR is input at a low level to the switch circuit 1023 of the vertical drive circuit 102.

The shift registers 1021 and 1022 of the vertical drive circuit 102 are supplied with the vertical start pulse VST for instructing the start of the vertical scan and vertical clocks VCK and VCKX having inverse phases to each other and serving as the reference of the vertical scan generated by a not illustrated clock generator. The shift registers 1021 and 1022 perform level shift operations of the vertical clocks, delay them with different delay times, and, as shown in FIGS. 16C and 16D, output the signal S1021 from the shift register 1021 to the switch circuit 1023 during one horizontal scan period and output the signal S1022 from the shift register 1022 to the switch circuit 1023 during the next horizontal scan period.

At the switch circuit 1023, the mode signal QTR is input at the high level, and the inverted mode signal XQTR is input at the low level, therefore the NAND circuits NA105 and NA106, as shown in FIGS. 16E and 16F, alternately output the signals S1023*a* and S1023*b* having the same phase as that of the output signals S1021 and S1022 of the shift registers 1021 and 1022 to the sampling latches 1024 and 1025 every horizontal scan period.

The sampling latch 1024 receives the first enable signal enb1/xenb1 having a duty of 50% as shown in FIG. 15, samples and latches the output signal S1023*a* of the switch circuit 1023 as shown in FIG. 16G, and outputs it to the negative power supply level shifter 1026. The sampling latch 1025 receives the second enable signal enb2/xenb2, samples and latches the output signal S1023*b* of the switch circuit 1023 as shown in FIG. 16H, and outputs it to the negative power supply level shifter 1027. At this time, the sampling latches 1024 and 1025 output the signals S1024 and S1025 in the VGA mode so as to set a predetermined interval between the falling timing of the drive signal of the previous stage (odd number stage) and the rising timing of the drive signal of the latter stage (even number stage) so that the periods of turning on and off the adjacent scan lines do not overlap.

Then, the negative power supply level shifters 1026 and 1027 successively supply drive signals S1026 and S1027 as the scan pulses of for example about 7.3V to the scan lines 104-1 and 104-2 for latch signals of the sampling latches 1024 and 1025. Further, the negative power supply level shifters 1026 and 1027 supply drive signals S1026 and S1027 shifted from 0V to −4.8V to the scan lines 104-1 and 104-2. Due to this, the TFT 101 of the pixel circuit PXLC at the time of the non-selection is reliably turned off. In this VGA mode, as shown in FIGS. 16A to 16H, in the horizontal scan period where the common voltage VCOM is the high level, the scan lines of the odd number rows are driven, while in the next horizontal scan period where the common voltage VCOM is the low level, the scan lines of the even number rows are driven. In this way, for every horizontal scan period, the first row scan line 104-1 to the m-th row scan line 104-m are successively driven.

The horizontal drive circuit 103 successively drives the R data transfer gates TMG-R1 and TMG-R2, the G data transfer gates TMG-G1 and TMG-G2, and the B data transfer gates TMG-B1 and TMG-B2 connected in parallel to the signal lines to the conductive state. Due to this, in the VGA mode when the load in the panel, particularly the capacity and the load of the signal line, is large, the driving capability of the signal line is exhibited to the maximum.

Then, the horizontal drive circuit 103 receives the horizontal start pulse HST for instructing the start of the horizontal scan and the horizontal clocks HCK and HCKX having inverse phases to each other and serving as the reference of the horizontal scan generated by a not illustrated clock generator, generates a sampling pulse, successively samples the input video signal in response to the sampling pulses generated, and supplies it as the data signal SDT to be written into the pixel circuits PXLC to the signal lines 105-1 to 105-n.

Concretely, first, it controls the selector switches TMG-R1 and TMG-R2 corresponding to R to the conductive state, outputs the R data to the signal lines, and writes the R data. When finishing writing the R data, it controls the selector switches TMG-G1 and TMG-G2 corresponding to G to the conductive state, outputs the G data to the signal lines, and writes the same. When the finishing writing the G data, it controls the selector switches TMG-B1 and TMG-B2 corresponding to B to the conductive state, outputs the B data to the signal lines, and writes the same.

Figure 17:
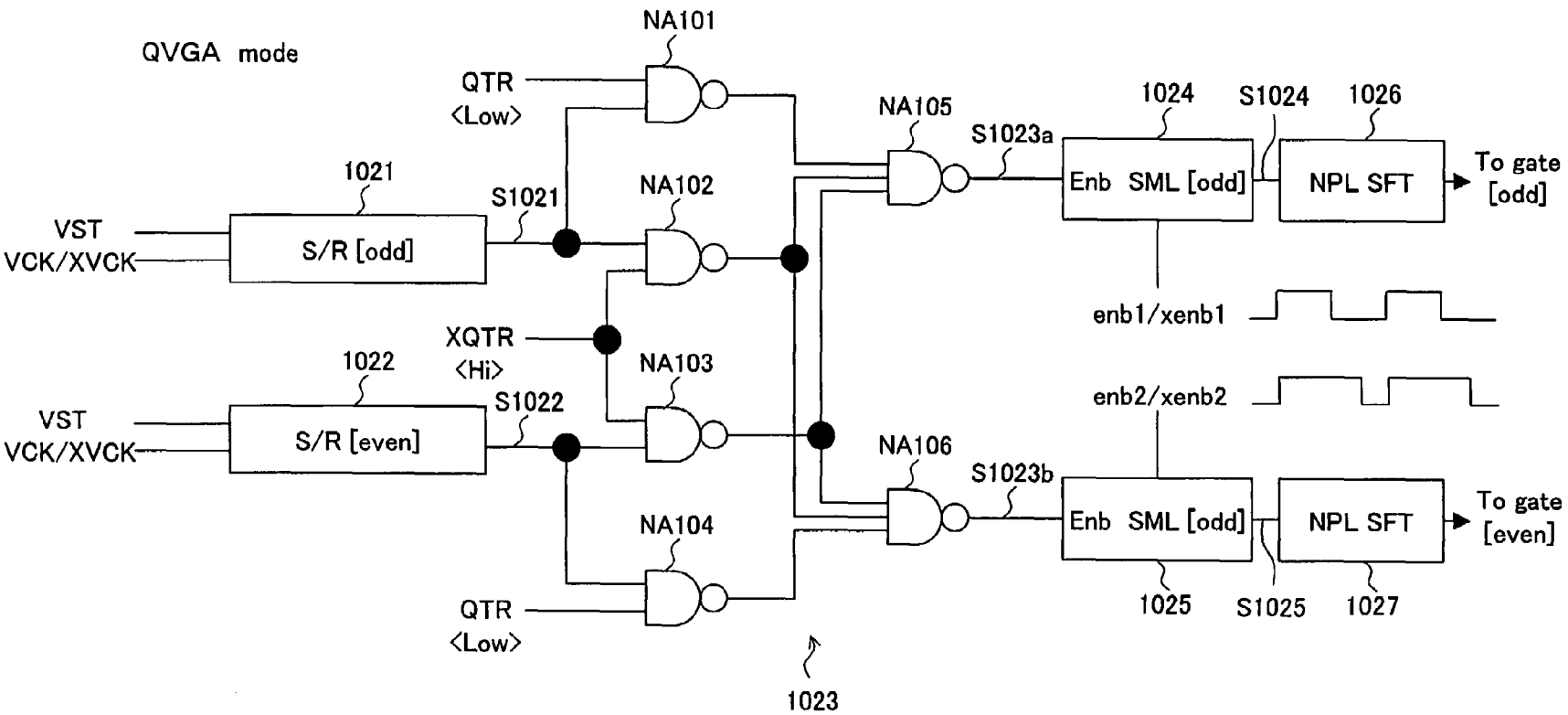
FIG. 17 is a circuit diagram of a vertical drive circuit when mode signals QTR and XQTR are input in the QVGA mode.
Figures 18A, 18B, 18C, 18D, 18E, 18F, 18G, 18H:
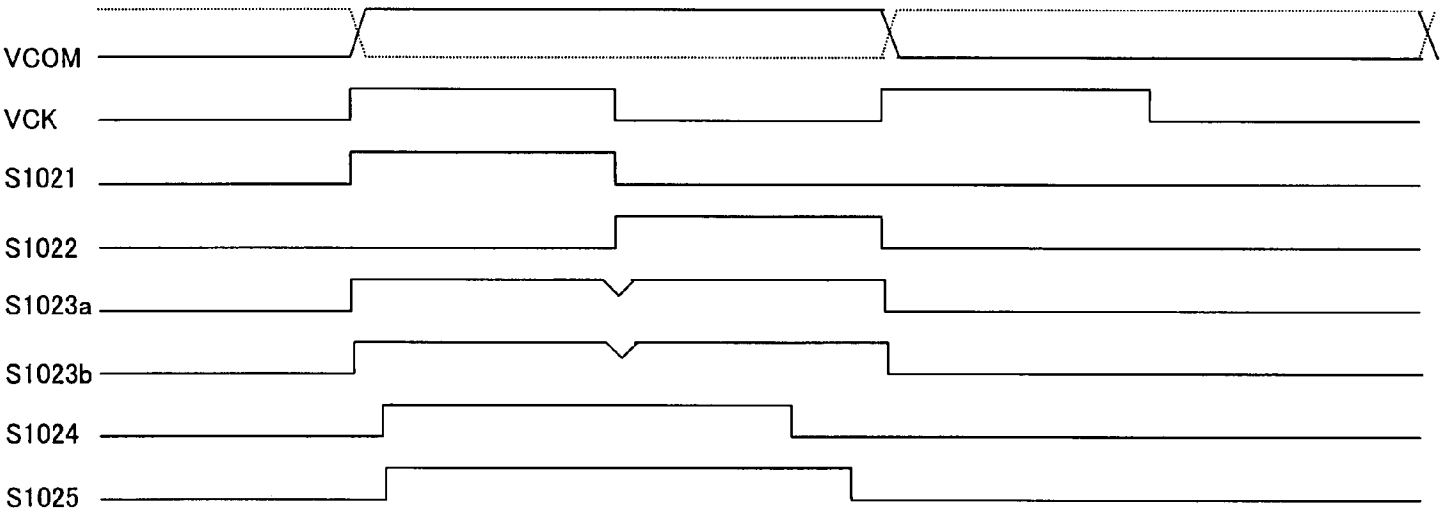
FIGS. 18A to 18H are timing charts for explaining the operation of a vertical drive circuit when the mode signals QTR and XQTR are input in the QVGA mode.

Next, the operation at the time of the QVGA mode will be explained in relation to FIG. 17 and FIGS. 18A to 18H. FIG. 17 is a circuit diagram of the vertical drive circuit 102 when the mode signals QTR and XQTR in the QVGA mode are input. FIG. 18A shows the common voltage VCOM having a polarity inverting for every 2 horizontal scan periods (2H) supplied to the other electrode of the storage capacitor Cs101 of each pixel circuit PXLC; FIG. 18B shows the vertical clock VCK serving as the reference of the vertical scan; FIG. 18C shows the output signal S1021 of the shift register 1021; FIG. 18D shows the output signal S1022 of the shift register 1022; FIG. 18E shows the output signal S1023*a* of the switch circuit 1023; FIG. 18F shows the output signal S1023*b* of the switch circuit 1023; FIG. 18G shows the output signal S1024 of the sampling latch 1024; and FIG. 18H shows the output signal S1025 of the sampling latch 1025.

In the QVGA mode, the mode signal QTR is input at the low level to the switch circuit 1023 of the vertical drive circuit 102 and the horizontal drive circuit 103, while the inverted mode signal XQTR is input at the high level to the switch circuit 1023 of the vertical drive circuit 102.

The shift registers 1021 and 1022 of the vertical drive circuit 102 are supplied with the vertical start pulse VST for instructing the start of the vertical scan and vertical clocks VCK and VCKX having inverse phases to each other and serving as the reference of the vertical scan generated by a not illustrated clock generator. The shift registers 1021 and 1022 perform level shift operations on the vertical clocks and delay them by different delay times. As shown in FIGS. 18C and 18D, the shift register 1021 outputs the signal S1021 to the switch circuit 1023 in 1 horizontal scan period, while the shift register 1022 outputs the signal S1022 to the switch circuit 1023 during the next horizontal scan period.

The switch circuit 1023 receives as input the mode signal QTR at the low level and receives as input the inverted mode signal XQTR at the high level, so the NAND circuits NA105 and NA106 generate, as shown in FIGS. 18E and 18F, pulses obtained by combining the output signals S1021 and S1022 of the shift registers 1021 and 1022 and output them as the signals S1023*a* and S1023*b* to the sampling latches 1024 and 1025 during 2 horizontal scan periods.

The sampling latch 1024 receives the first enable signal enb1/xenb1 having a duty of 50% as shown in FIG. 17, samples and latches the output signal S1023*a* of the switch circuit 1023 as shown in FIG. 18G, and outputs it to the negative power supply level shifter 1026. The sampling latch 1025 receives the second enable signal enb2/xenb2 having the same cycle as the first enable signal enb1/xenb1 but having a different duty (longer in the period of high level) as shown in FIG. 17, samples and latches the output signal S1023*b* of the switch circuit 1023 as shown in FIG. 18H, and outputs it to the negative power supply level shifter 1027. At this time, the sampling latches 1024 and 1025 make the timing of the falling of the scan pulses SP101, SP103, . . . , SP10m-1 of the odd number stages earlier than the timing of the falling of the scan pulses SP102, SP104, . . . , SP101 of the even number stages in the QVGA mode, in other words, delay the timing of the falling of the scan pulses SP102, SP104, . . . , SP10m1 of the even number stages from the timing of the falling of the scan pulses SP101, SP103, . . . , SP10m-1 of the odd number stages and output the signals S1025 and S1026. Due to this, the coupling amounts received by the pixel circuits are made uniform, whereby the horizontal streaks are made to disappear.

Then, the negative power supply level shifters 1026 and 1027 successively supply the drive signals S1026 and S1027 as the scan pulses of for example about 7.3V to the scan lines 104-1 and 104-2 for the latch signals of the sampling latches 1024 and 1025. Further, the negative power supply level shifters 1026 and 1027 supply the drive signals S1026 and S1027 shifted in level from 0V to −4.8V to the scan lines 104-1 and 104-2. Due to this, the TFT 101 of the pixel circuit PXLC at the time of non-selection is reliably turned off. In this QVGA mode, as shown in FIGS. 18A to 18H, in the 2 horizontal scan periods where the common voltage VCOM is the high level, the scan lines of the adjacent odd number row and the even number row are simultaneously driven in parallel, and during the next 2 horizontal scan periods where the common voltage VCOM is the low level, the scan lines of the next adjacent odd number row and even number row are simultaneously driven in parallel. In this way, for every 2 horizontal scan periods, the scan lines 104-1 and 104-2 of the first row and the second row to the scan lines 104-m-1 and 104-m of the m-1-th row and the 2m-th row are successively driven for every 2 rows.

The horizontal drive circuit 103 successively controls only one side transfer gates TMG-R1, TMG-G1, and TMG-B1 among the pairs of transfer gates connected in parallel with respect to the signal lines, i.e., the R data use transfer gates TMG-R1 and TMG-R2, the G data use transfer gates TMG-G1 and TMG-G2, and the B data use transfer gates TMG-B1 and TMG-B2, to the conductive state and holds the remaining transfer gates TMG-R2, TMG-G2, and TMG-B2 in the non-conductive state. Due to this, in the QVGA mode where the load in the panel, particularly the capacity and the load of the signal line, is relatively small, the driving capability of the signal lines is limited to a half of that in the VGA mode, and the wasteful consumption of power is prevented.

The horizontal drive circuit 103 receives the horizontal start pulse HST for instructing the start of the horizontal scan and the horizontal clocks HCK and HCKX having inverse phases to each other and serving as reference of the horizontal scan generated by a not illustrated clock generator, generates sampling pulses, successively samples the input video signal in response to the sampling pulses generated, and supplies the same as the data signal SDT to be written into the pixel circuits PXLC to the signal lines 105-1 to 105-n. Concretely, first, it controls the selector switch TMG-R1 corresponding to R to the conductive state, outputs the R data to the signal lines, and writes the R data. When finishing writing the R data, it controls the selector switch TMG-G1 corresponding to G to the conductive state, outputs the G data to the signal lines, and writes the same. When finishing writing the G data, it controls the selector switch TMG-B1 corresponding to B to the conductive state, outputs the B data to the signal lines, and writes the same.

As explained above, according to the present embodiment, since provision is made of the vertical drive circuit 102 for performing processing for deciding the mode is the VGA mode when receiving the mode signal QTR at the high level and XQTR at the low level having inverse phases to each other, scanning the scan lines for every field period in the vertical direction (row direction), and successively selecting the pixel circuits PXLC connected to the scan lines 104-1 to 104-m in units of rows and performing processing for deciding the mode is the QVGA mode when receiving the mode signal QTR at the low level and XQTR at the low level, scanning the scan lines for every 2 field periods in the vertical direction (row direction) and successively selecting the pixel circuits PXLC connected to the scan lines 104-1 to 104-m in units of two rows, a panel having two resolutions can be realized by one panel. Namely, there are the advantages that driving capabilities corresponding to a plurality of resolutions can be selected, the panel can be driven in accordance with the purpose, and a lower power consumption can be realized.

Further, in the present embodiment, the vertical drive circuit 102 makes the timing of the falling of the scan pulses SP101, SP103, . . . , SP10m-1 of the odd number stages earlier than the timing of the falling of the scan pulses SP102, SP104, . . . , SP10m1 of the even number stages, in other words, delays the timing of the falling of the scan pulses SP102, SP104, . . . , SP10m1 of the even number stages from the timing of the falling of the scan pulses SP101, SP103, . . . , SP10m-1 of the odd number stages, so has the advantages that it is possible to make the coupling amounts received by the pixel circuits uniform, whereby the horizontal streaks are made to disappear, and achieve an improvement of the image quality.

Further, in the present embodiment, since provision is made of the horizontal drive circuit 103 provided with the selector 107 having the selector switches 1071-R, 1071-G, 1071-B, . . . , 1074-R, 1074-G, 1074-B, . . . , (107n-R, 107n-G, 107n-B), having the selector switches 1071-R, 1071-G, 1071-B, . . . , 1074-R, 1074-G, 1074-B, . . . , (107n-R, 107n-G, 107n-B) configured by pairs of the transfer gates TMG-R1 and TMG-R2, TMG-G1 and TMG-G2, and TMG-B1 and TMG-B2 connected in parallel to the signal lines and having equivalent transistor sizes, using both transfer gates TMG-R1 and TMG-R2 to drive the signal lines for exhibiting the driving capability to the maximum in the VGA mode, and using only one transfer gate TMG-R1 to drive the signal lines in the QVGA mode, there are the advantages that driving capabilities corresponding to a plurality of resolutions can be selected, the panel can be driven in accordance with the purpose, and particularly a lower power consumption at the time of the QVGA mode can be realized.

FIG. 19 is a view of the results of simulation for the power consumption of the selector of the horizontal drive circuit according to the present embodiment. In this case, as the transistor size of the selector switches, use was made of transistors having a channel width W of 500 μm and a channel length L of 6 μm. As shown in FIG. 19, the power consumption in the VGA mode is 8.5 mW. Further, in the QVGA mode, in contrast to a circuit (Ref circuit) not employing the horizontal drive circuit according to the present embodiment wherein the power consumption is 4.24 mW, the power consumption becomes 2.13 mW in the horizontal drive circuit according to the present embodiment. Namely, in the horizontal drive circuit according to the present embodiment, the power consumption can be reduced by about 2 mW in comparison with the conventional circuit and the power consumption can be reduced by about 6 mW in comparison with the VGA mode.

Figure 20:
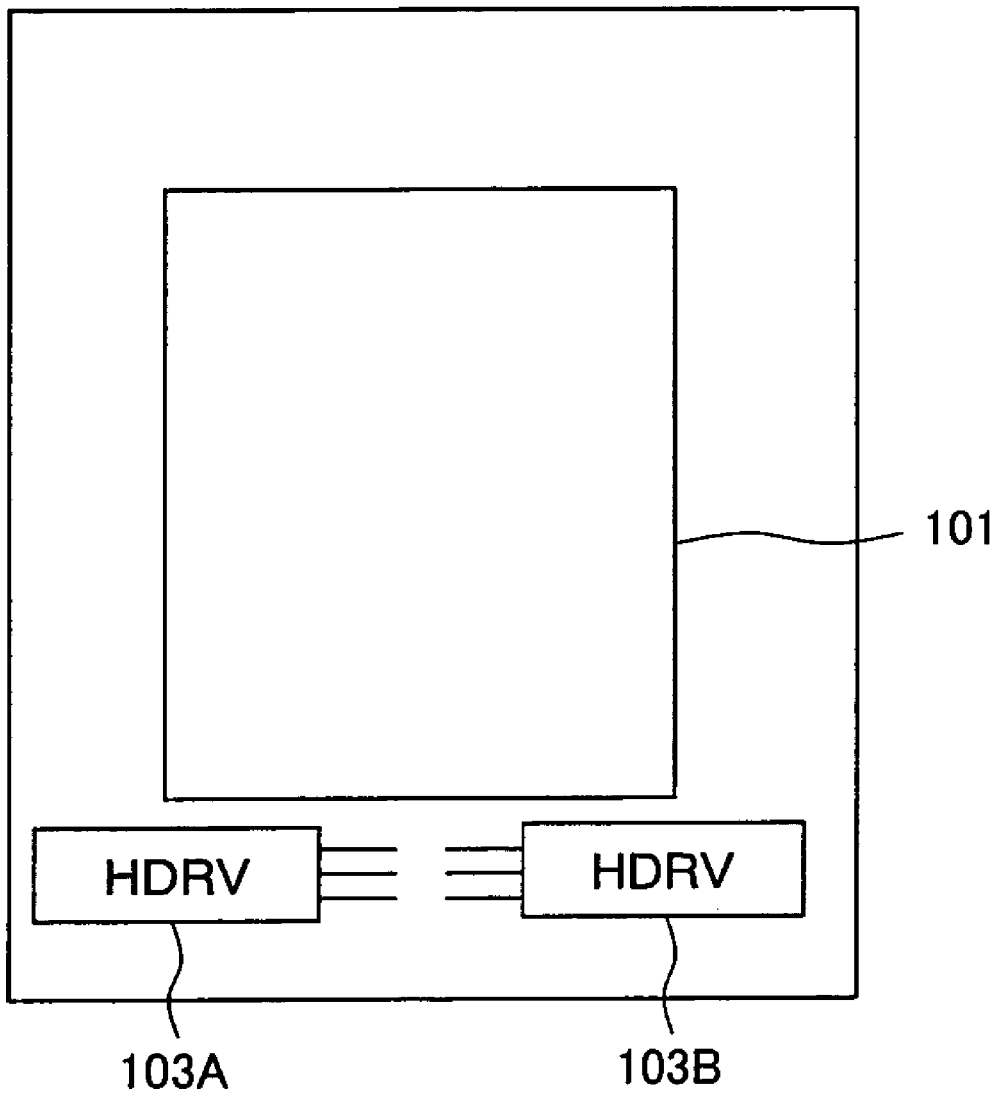
FIG. 20 is a view of another embodiment of a liquid crystal display device according to the present invention.

Further, while the case where the horizontal drive circuit drives all signal lines (480) by one circuit was explained as an example, for example, as shown in FIG. 20, it is also possible to configure the horizontal drive circuit so as to provide a first horizontal drive circuit 103A and a second horizontal drive circuit 103B and to drive 240 signal lines, i.e., half, by each. In this case, since the load in the panel increases in a panel having a large number of pixels where the resolution is VGA, the layout area becomes too large on one side. Further, when it is desired to drive a large load on one side, the number of transistors and size become large, a delay is generated in the pulse for turning on the selector switches, and the error margin becomes large. Therefore, as shown in FIG. 20, desirably the first horizontal drive circuit 103A and the second horizontal drive circuit 103B are arranged on the left and right sides. The first horizontal drive circuit 103A and the second horizontal drive circuit 103B can be inspected as to which horizontal drive circuit is defected in an inspection step in production by not connecting their interconnects.

Note that, in the above embodiment, an explanation was given of the case where the present invention was applied to a liquid crystal display device mounting the drive circuit for receiving as input the digital video signal and writing the video signal into the pixels line by line by the selector system, but the present invention can be similarly applied to a liquid crystal display device mounting an analog interface drive circuit receiving as input the analog video signals, latching them, and then writing the analog video signals into pixels line by line.

Further, in the above embodiment, the explanation was given taking as an example the case of application of the present invention to an active matrix type liquid crystal display device using liquid crystal cells as display elements (electro-optical elements) of the pixels, but the invention is not limited to application to a liquid crystal display device. The present invention can be applied to an active matrix type EL display device using electroluminescence (EL) elements as the display elements of the pixels or any other active matrix type display devices of the point sequence drive method employing the clock drive method for the horizontal drive circuit. As the point sequence drive method, other than the well known 1H inversion drive method and dot inversion drive method, there is the so-called dot-line inversion drive method for simultaneously writing video signals having inverse polarities with each other into pixels of two rows separated by an odd number of rows between adjacent pixel columns, for example, an-upper and lower row, so that the polarities of pixels in a pixel array after writing the video signal become the same between adjacent left and right pixels and become inverse between upper and lower pixels. The active matrix type liquid crystal display device of the point sequence drive method according to the embodiment explained above can be used as the display panel of a projection type liquid crystal display device (liquid crystal projector), that is, a liquid crystal display (LCD) panel.

Summarizing the effects of the invention, as explained above, according to the present invention, there are the advantages that a driving capability corresponding to a plurality of resolutions can be selected, the display device can be driven in accordance with the purpose, and a reduction of the power consumption particularly in the QVGA mode can be realized. Further, there are the advantages that it is possible to make the amounts of coupling received by the pixel circuits uniform to eliminate horizontal streaks and improve the image quality.

While the invention has been described with reference to specific embodiments chosen for purpose of illustration, it should be apparent that numerous modifications could be made thereto by those skilled in the art without departing from the basic concept and scope of the invention.

What is claimed is:

1. A display device having at least a different resolution first mode and second mode having a lower resolution than said first mode, comprising:

a pixel portion comprised of pixel circuits, for writing pixel data into pixel cells through switching elements, arranged so as to form a matrix of at least a plurality of rows;

a plurality of scan lines arranged so as to correspond to a row arrangement of said pixel circuits and controlling conduction of said switching elements;

at least one signal line arranged so as to correspond to a column arrangement of said pixel circuits and propagating said pixel data; and a vertical drive circuit including a plurality of switch circuits, each switch circuit coupling an adjacent plurality of scan lines in the row direction, the switch circuits adapting the vertical drive circuit to successively transmit scan pulses along said scan lines in a row direction and successively select the pixel circuits connected to the scan lines in units of rows in said first mode, and successively scan transmit scan pulses along adjacent pluralities of said scan lines in the row direction and successively select the pixel circuits connected to said plurality of scan lines in units of the plurality of rows in said second mode; and wherein each switch circuit include an input for the adjacent scan lines and at least one mode signal.

2. A display device as set forth in claim 1, wherein during the second mode, said vertical drive circuit sets an edge timing of all scan pulses for a given successive plurality of scan lines in parallel.

3. A display device as set forth in claim 1, further comprising a horizontal drive circuit including a selector having selector switches for selecting the pixel data and supplying the pixel data to said signal lines, said selector switches formed by connecting pluralities of switches in parallel to the corresponding signal lines, making said pluralities of switches conductive and outputting the selected pixel data to the signal lines through said pluralities of switches in said first mode, and making any switches among said pluralities of switches conductive and outputting the selected pixel data to the signal lines through said switches in said second mode.

4. A display device as set forth in claim 2, further comprising a horizontal drive circuit including a selector having selector switches for selecting the pixel data and supplying the pixel data to said signal lines, said selector switches formed by connecting pluralities of switches in parallel to the corresponding signal lines, making said pluralities of switches conductive and outputting the selected pixel data to the signal lines through said pluralities of switches in said first mode, and making any switches among said pluralities of switches conductive and outputting the selected pixel data to the signal lines through said switches in said second mode.

5. A display device as set forth in claim 1, wherein said display device:

comprises a plurality of said signal lines and comprises a plurality of horizontal drive circuits dividing said plurality of signal lines into a plurality of groups and supplying pixel data to the signal lines corresponding to the divided groups.

6. A display device as set forth in claim 1, wherein said display device:

comprises a plurality of said signal lines and comprises a plurality of horizontal drive circuits dividing said plurality of signal lines into a plurality of groups and supplying pixel data to the signal lines corresponding to the divided groups, each horizontal drive circuit including a selector having selector switches for selecting the pixel data and supplying the same to said signal lines, said selector switches formed by connecting pluralities of switches in parallel to the corresponding signal lines, making said pluralities of switches conductive and outputting the selected pixel data to the signal lines through said pluralities of switches in said first mode, and making any switches among said pluralities of switches conductive and outputting the selected pixel data to the signal lines through said switches in said second mode.

7. A display device as set forth in claim 2, wherein said display device:

comprises a plurality of said signal lines and comprises a plurality of horizontal drive circuits dividing said plurality of signal lines into a plurality of groups and supplying pixel data to the signal lines corresponding to the divided groups, each horizontal drive circuit including a selector having selector switches for selecting the pixel data and supplying the same to said signal lines, said selector switches formed by connecting pluralities of switches in parallel to the corresponding signal lines, making said pluralities of switches conductive and outputting the selected pixel data to the signal lines through said pluralities of switches in said first mode, and making any switches among said pluralities of switches conductive and outputting the selected pixel data to the signal lines through said switches in said second mode.

8. A display device as set forth in claim 1, wherein said pixel cells are liquid crystal cells.

9. A display device as set forth in claim 1, wherein each switch circuit couples adjacent scan lines in pairs of an odd scan line and even scan line.

10. A method of driving a display device including a pixel portion comprised of pixel circuits, for writing pixel data into pixel cells through switching elements, arranged so as to form a matrix of at least a plurality of rows and a plurality of scan lines arranged so as to correspond to the row arrangement of said pixel circuits and for controlling the conduction of said switching elements, comprising using a plurality of switch circuits, each switch circuit coupling an adjacent plurality of scan lines in the row direction to perform the steps of:

successively transmitting scan pulses along said scan lines in the row direction and successively selecting the pixel circuits connected to the scan lines in units of rows in a first mode having a predetermined resolution and successively transmitting scan pulses along adjacent pluralities of said scan lines in the row direction and successively selecting the pixel circuits connected to said plurality of scan lines in units of said plurality of rows in a second mode having a lower resolution than said first mode and wherein each switch circuit include an input for the adjacent scan lines and at least one mode signal.

11. A method of driving a display device as set forth in claim 10, further comprising setting a rear edge timing of the scan pulses for outputting the scan pulses to be output to a plurality of scan lines to be scanned simultaneously in parallel to the scan lines of a previous stage earlier than the rear edge timing of the scan pulses to be output to the scan lines of the next stage in said second mode.

12. A method of driving a display device as set forth in claim 10, wherein said pixel cells are liquid crystal cells.

13. A display device having at least a different resolution first mode and second mode having a lower resolution than said first mode, comprising:

a pixel portion comprised of pixel circuits, for writing pixel data into pixel cells through switching elements, arranged so as to form a matrix of at least a plurality of rows;

a plurality of scan lines arranged so as to correspond to a row arrangement of said pixel circuits and controlling conduction of said switching elements;

at least one signal line arranged so as to correspond to a column arrangement of said pixel circuits and propagating said pixel data; and a vertical drive circuit including a plurality of switch circuits, each switch circuit coupling an adjacent plurality of scan lines in the row direction, the switch circuits adapting the vertical drive circuit to successively transmit scan pulses along said scan lines in a row direction and successively select the pixel circuits connected to the scan lines in units of rows in said first mode, and successively scan transmit scan pulses along adjacent pluralities of said scan lines in the row direction and successively select the pixel circuits connected to said plurality of scan lines in units of the plurality of rows in said second mode; and wherein when the display device is in the first mode, the plurality of switches switch do not effect the scan pulses output by the vertical drive circuit, and when the display device is in the second mode plurality of switches combines the scan pulses of the coupled scan lines and outputs the combined scan pulses along the adjacent plurality of scan lines.

14. A display device having at least a different resolution first mode and second mode having a lower resolution than said first mode, comprising:

a pixel portion comprised of pixel circuits, for writing pixel data into pixel cells through switching elements, arranged so as to form a matrix of at least a plurality of rows;

a plurality of scan lines arranged so as to correspond to a row arrangement of said pixel circuits and controlling conduction of said switching elements;

at least one signal line arranged so as to correspond to a column arrangement of said pixel circuits and propagating said pixel data; and a vertical drive circuit including a plurality of switch circuits, each switch circuit coupling an adjacent plurality of scan lines in the row direction, the switch circuits adapting the vertical drive circuit to successively transmit scan pulses along said scan lines in a row direction and successively select the pixel circuits connected to the scan lines in units of rows in said first mode, and successively scan transmit scan pulses along adjacent pluralities of said scan lines in the row direction and successively select the pixel circuits connected to said plurality of scan lines in units of the plurality of rows in said second mode; and wherein the at least one mode signal comprises at least one non-pulsing signal representing whether the display device is operating in the first mode or second mode.

15. A display device having at least a different resolution first mode and second mode having a lower resolution than said first mode, comprising:

a pixel portion comprised of pixel circuits, for writing pixel data into pixel cells through switching elements, arranged so as to form a matrix of at least a plurality of rows;

a plurality of scan lines arranged so as to correspond to a row arrangement of said pixel circuits and controlling conduction of said switching elements;

at least one signal line arranged so as to correspond to a column arrangement of said pixel circuits and propagating said pixel data; and a vertical drive circuit including a plurality of switch circuits, each switch circuit coupling an adjacent plurality of scan lines in the row direction, the switch circuits adapting the vertical drive circuit to successively transmit scan pulses along said scan lines in a row direction and successively select the pixel circuits connected to the scan lines in units of rows in said first mode, and successively scan transmit scan pulses along adjacent pluralities of said scan lines in the row direction and successively select the pixel circuits connected to said plurality of scan lines in units of the plurality of rows in said second mode: and wherein the vertical drive circuit comprises:

a plurality of shift registers;

a plurality of sampling latches; and a plurality of power supply level shifters;

each scan line in the vertical drive circuit being exclusive associated with a corresponding shift register, a corresponding sampling latch and a corresponding power supply level shifter, and the output of each shift register corresponding a scan line is input to a switch circuit, the switch circuit having an input corresponding with each scan line and an output corresponding to each scan line, and the outputs from the switch circuit corresponding to each scan line inputs data to the sampling latches corresponding to each scan line.

* * * * *